US009298146B2

(12) United States Patent
Yoshiura et al.

(10) Patent No.: US 9,298,146 B2
(45) Date of Patent: Mar. 29, 2016

(54) FIXING DEVICE AND IMAGE FORMING APPARATUS

(71) Applicants: Arinobu Yoshiura, Kanagawa (JP); Hideo Nagafuji, Kanagawa (JP); Yuji Arai, Kanagawa (JP); Kohichi Utsunomiya, Kanagawa (JP); Shohei Saito, Kanagawa (JP); Qifeng Cui, Tokyo (JP); Yutaka Ikebuchi, Kanagawa (JP); Motoyoshi Yamano, Tokyo (JP); Kenji Ishii, Kanagawa (JP); Hiromasa Takagi, Tokyo (JP); Keitaro Shoji, Kanagawa (JP)

(72) Inventors: Arinobu Yoshiura, Kanagawa (JP); Hideo Nagafuji, Kanagawa (JP); Yuji Arai, Kanagawa (JP); Kohichi Utsunomiya, Kanagawa (JP); Shohei Saito, Kanagawa (JP); Qifeng Cui, Tokyo (JP); Yutaka Ikebuchi, Kanagawa (JP); Motoyoshi Yamano, Tokyo (JP); Kenji Ishii, Kanagawa (JP); Hiromasa Takagi, Tokyo (JP); Keitaro Shoji, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/644,903

(22) Filed: Mar. 11, 2015

(65) Prior Publication Data

US 2015/0261155 A1 Sep. 17, 2015

(30) Foreign Application Priority Data

Mar. 17, 2014 (JP) ..... 2014-053226
Jul. 28, 2014 (JP) ..... 2014-152819
Sep. 12, 2014 (JP) ..... 2014-186162

(51) Int. Cl.
*G03G 15/20* (2006.01)

(52) U.S. Cl.
CPC ..... *G03G 15/2085* (2013.01); *G03G 15/2053* (2013.01); *G03G 15/2042* (2013.01); *G03G 2215/2035* (2013.01)

(58) Field of Classification Search
CPC ..... G03G 15/2085
See application file for complete search history.

(56) References Cited

U.S. PATENT DOCUMENTS

2006/0216077 A1* 9/2006 Komuro ..... 399/328
2007/0292175 A1 12/2007 Shinshi (Continued)

FOREIGN PATENT DOCUMENTS

JP 4818826 9/2011
JP 2012-145633 8/2012

(Continued)

OTHER PUBLICATIONS

U.S. Appl. No. 14/531,313, filed Nov. 3, 2014.

(Continued)

*Primary Examiner* — G. M. Hyder
(74) *Attorney, Agent, or Firm* — Oblon, McClelland, Maier & Neustadt, L.L.P.

(57) ABSTRACT

A fixing device includes: a rotatable fixing member formed as an endless belt; a heat source to heat the fixing member; a nip-forming member being not rotatable and arranged inside the fixing member; and a pressure member arranged outside the fixing member and forming a nip between the pressure member and the fixing member. The nip-forming member is formed of a first heat transmission unit and a sliding sheet. The first heat transmission unit includes an abutting part abutting the fixing member with the sliding sheet therebetween, and a bent part or bent parts extending inside the fixing member at upstream or upstream and downstream of the nip in a transport direction of a recording medium. A retaining part to catch and retain the sliding sheet is provided at a tip of at least the bent part at upstream of the nip in the transport direction.

18 Claims, 19 Drawing Sheets

(56) References Cited

U.S. PATENT DOCUMENTS

| | | | | |
|---|---|---|---|---|
| 2010/0202809 | A1* | 8/2010 | Shinshi et al. | 399/329 |
| 2010/0290822 | A1 | 11/2010 | Hasegawa et al. | |
| 2010/0290823 | A1 | 11/2010 | Okabe et al. | |
| 2010/0296849 | A1 | 11/2010 | Yamamoto et al. | |
| 2011/0076071 | A1 | 3/2011 | Yamaguchi et al. | |
| 2011/0116848 | A1 | 5/2011 | Yamaguchi et al. | |
| 2011/0150543 | A1* | 6/2011 | Fujiwara et al. | 399/328 |
| 2011/0217056 | A1 | 9/2011 | Yoshinaga et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2013/0164056 | A1 | 6/2013 | Imada et al. | |
| 2013/0164058 | A1 | 6/2013 | Suzuki et al. | |
| 2013/0164059 | A1 | 6/2013 | Takagi et al. | |
| 2013/0170877 | A1 | 7/2013 | Yoshiura et al. | |
| 2013/0170880 | A1 | 7/2013 | Gotoh et al. | |
| 2013/0177340 | A1 | 7/2013 | Kawata et al. | |
| 2013/0183070 | A1 | 7/2013 | Kawata et al. | |
| 2013/0188991 | A1 | 7/2013 | Kawata et al. | |
| 2013/0189005 | A1 | 7/2013 | Saito et al. | |
| 2013/0189008 | A1 | 7/2013 | Ishii et al. | |
| 2013/0195477 | A1 | 8/2013 | Seshita et al. | |
| 2013/0195523 | A1 | 8/2013 | Yamaji et al. | |
| 2013/0195524 | A1 | 8/2013 | Ishii et al. | |
| 2013/0195525 | A1 | 8/2013 | Yoshinaga et al. | |
| 2013/0209119 | A1 | 8/2013 | Yuasa et al. | |
| 2013/0209125 | A1 | 8/2013 | Uchitani et al. | |
| 2013/0209131 | A1 | 8/2013 | Uchitani et al. | |
| 2013/0209147 | A1 | 8/2013 | Ogawa et al. | |
| 2013/0251422 | A1 | 9/2013 | Iwaya et al. | |
| 2013/0266355 | A1 | 10/2013 | Yoshiura et al. | |
| 2014/0016972 | A1 | 1/2014 | Seshita et al. | |
| 2014/0064804 | A1 | 3/2014 | Yamaguchi et al. | |
| 2014/0079453 | A1 | 3/2014 | Arai et al. | |
| 2014/0153983 | A1 | 6/2014 | Fujii et al. | |
| 2015/0055993 | A1 | 2/2015 | Shoji | |

FOREIGN PATENT DOCUMENTS

| | | | |
|---|---|---|---|
| JP | 2015-31777 | A | 2/2015 |
| WO | 2015-64560 | A | 4/2015 |

OTHER PUBLICATIONS

U.S. Appl. No. 14/467,135, filed Aug. 25, 2014.
U.S. Appl. No. 14/467,341, filed Aug. 25, 2014.
U.S. Appl. No. 14/504,626, filed Oct. 2, 2014.
Extended European Search Report issued Jul. 9, 2015 in Patent Application No. 15156808.6.

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2014-053226 filed in Japan on Mar. 17, 2014, Japanese Patent Application No. 2014-152819 filed in Japan on Jul. 28, 2014 and Japanese Patent Application No. 2014-186162 filed in Japan on Sep. 12, 2014.

BACKGROUND OF THE INVENTION

1. Field of the Invention

The present invention relates to a fixing device for use in an image forming apparatus such as a copier, a printer, or a fax machine, and to an image forming apparatus including the fixing device.

2. Description of the Related Art

Recently, an image forming device, such as a copier, a printer, or a fax machine, forms images through an image forming process such as electrophotographic recording, electrostatic recording, and magnetic recording, and forms unfixed toner images by the image transfer method or the direct method on recording materials such as recording material sheets, printing paper, photosensitive paper, or electrostatic recording paper. A known example of a fixing device for fixing an unfixed toner image performs a fixing process by applying heat and pressure to the toner image formed on recording paper while placing the image at a nip part between an endless belt and a pressure roller.

In such a fixing device, heating the entirety of the belt has been made possible. Thus, the fixing device can have a reduced first print time from the heating standby time and can avoid shortage in the amount of heat at the high-speed rotation and attain a favorable fixing quality even when mounted on an image forming apparatus having high productivity.

A fixing device is built on the premise that various recording media pass through the device, and thus a recording medium the width of which is smaller than a heat generation width of a heater of the fixing member in the axial direction of the heater may pass therethrough, for example.

In the above-described fixing device, when such a recording medium passes, a region of the fixing member through which no sheet passes is not deprived of heat by the recording medium, thereby coming to have an excess amount of heat (a temperature increase at a no-sheet passing portion). This temperature increase accelerates deterioration of the fixing member, thereby making the life thereof shorter.

In response to this inconvenience, another fixing device has been developed to avoid a temperature increase at a no-sheet passing portion. This fixing device includes, as a nip-forming member, a heat-averaging member made of a material having high thermal conductivity and has the heat-averaging member in constant contact with the inner side of a fixing belt.

However, in the fixing device having the heat-averaging member in constant contact with the inner side of the fixing belt, the nip-forming member and the fixing belt make direct contact with and slide over each other. Therefore, the fixing device is disadvantageous in terms of durability and temperature stability of the fixing belt.

In order to overcome such disadvantages, another known fixing device includes a nip-forming member provided with a sliding sheet made of a low-friction material (refer to, for example, Japanese Patent No. 4818826). Specifically, a sliding sheet 601 is wound around a nip-forming member 600 as illustrated in FIGS. 24A and 24B. Thereafter, the sliding sheet 601 is fastened to the nip-forming member 600 by a screw 603 provided as a fastening member with a securing member 602 therebetween. Additionally, a plurality of projecting parts 600*a* are provided at the center in the width direction of the nip-forming member 600 and on one side thereof opposite to a nip-forming side thereof. The projecting parts 600*a* abut a reinforcing member (not illustrated) for supporting the nip-forming member 600. As illustrated in FIG. 25, the sliding sheet 601 overlaps with itself in a region thereof contacted by the securing member 602, and is fastened to the nip-forming member 600 by the fastening member 603. Furthermore, double-faced adhesive tape 604 is stuck on the nip-forming surface of the nip-forming member 600. This configuration makes it possible to have a fixing belt without disadvantages in term of durability and temperature stability.

In the fixing device disclosed in Japanese Patent No. 4818826, however, there has been a disadvantage associated with attachment of the sliding sheet to the nip-forming member, such that: fixation of the sliding sheet and arrangement of projecting parts are concentrated on one side surface of the nip-forming member opposite to the side thereof having the nip part; and it has therefore been difficult that, while the sliding sheet is fixed to the nip-forming member so as to appropriately make slidable contact with the fixing belt, the projecting parts are arranged so as to appropriately abut a reinforcing member. There has been another disadvantage such that, depending on how the sliding sheet is attached, the arrangement precision of the nip-forming member inside a unit may be reduced and the nip part is not appropriately formed. There has been still another disadvantage such that, since the sliding sheet is wound at least one turn around the nip-forming member in as direction of the short side thereof, the component cost for the sliding sheet is high and hinders cost reduction.

There is a need to provide a fixing device that, while having a simple structure, prevents temperature increase at a no-sheet passing portion and has a fixing belt the durability and temperature stability of which are ensured.

SUMMARY OF THE INVENTION

It is an object of the present invention to at least partially solve the problems in the conventional technology.

A fixing device includes: a rotatable fixing member formed as an endless belt; a heat source to heat the fixing member; a nip-forming member being not rotatable and arranged inside the fixing member; and a pressure member arranged outside the fixing member so as to face the nip-forming member, the pressure member forming a nip between the pressure member and the fixing member. The fixing device causes a recording medium bearing an unfixed image to pass through the nip to fix the unfixed image to the recording medium. The nip-forming member is formed of a first heat transmission unit and a sliding sheet. The first heat transmission unit includes an abutting part abutting the fixing member with the sliding sheet therebetween, and a bent part or bent parts extending inside the fixing member at upstream or upstream and downstream of the nip in a transport direction of the recording medium. A retaining part to catch and retain the sliding sheet is provided at a tip of at least the bent part at upstream of the nip in the transport direction of the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
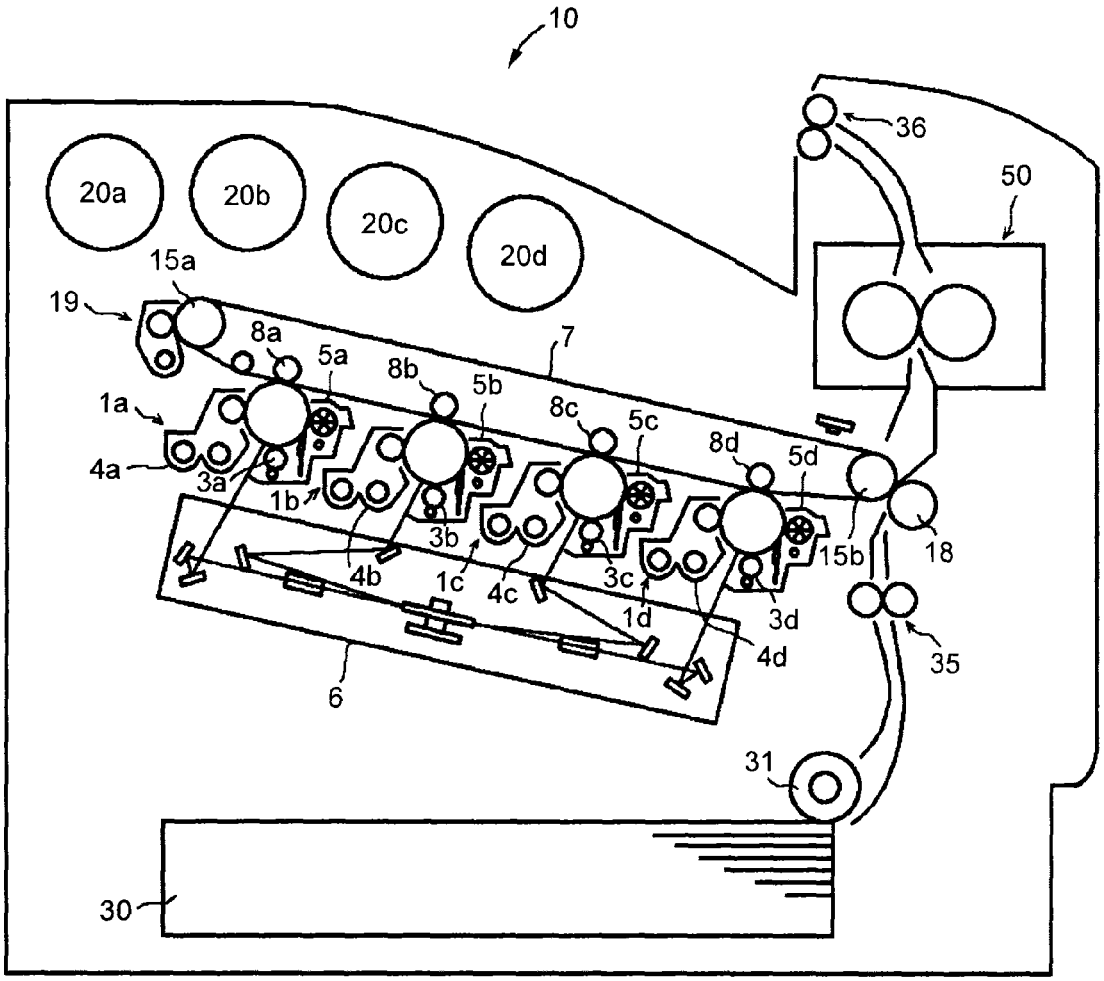
FIG. 1 is a configuration diagram schematically illustrating an image forming apparatus according to one embodiment of the present invention.

Next, one embodiment according to the present invention is described in accordance with the drawings. Note that, an identical reference sign is assigned to component elements, such as members or component parts, having the same function or shape as far as that function or shape is recognizable in the drawings, and a description of such component elements is given only one time and omitted thereafter.

FIG. 1 is a schematic cross-sectional view illustrating one example of an image forming apparatus as a color printer 10 that includes a fixing device according to the present invention. The image forming apparatus 10 illustrated here includes a fixing device 50 to be described later and an electrophotographic image forming unit, and the image forming unit includes a plurality of (four, in the illustrated example) image forming devices 1*a*, 1*b*, 1*c*, and 1*d*. These first to fourth image forming devices 1*a*, 1*b*, 1*c*, and 1*d* have the same structure, and differ only in corresponding toner color. Thus, for example, a black toner image, a magenta toner image, a cyan toner image, and a yellow toner images are formed in the respective image forming devices. Note that, since these image forming devices have the same structure and differ only in developer (toner) color, the suffixes, a, b, c, and d, in reference signs are omitted as appropriate in the following descriptions.

In each of the image forming devices 1, a drum-shaped photoconductor 2 is arranged, which is an electrostatic latent image bearer, and a charging member 3, a developing device 4, and a cleaning device 5 are provided around the photoconductor 2. This photoconductor 2 can be driven to rotate clockwise, and the charging member 3 is in pressure contact with the outer surface thereof. With this structure, when the photoconductor 2 is driven to rotate, this charging member 3 is rotated by the rotation. Additionally, a predetermined bias voltage is applied to this charging member 3 from a high voltage power supply not illustrated, so that the outer surface of the photoconductor 2 being driven to rotate can be uniformly charged. Although a roller-shaped member that makes contact with the photoconductor 2 is employed as the charging member 3 illustrated here, a contactless member utilizing a corona discharge can be employed alternatively.

Furthermore, the image forming apparatus 10 illustrated in FIG. 1 includes an exposure device 6 in parallel to and diagonally below the four image forming devices. This exposure device 6 appropriately includes appropriate component members such as a light source, a polygon mirror, an f-θ lens, and a reflecting mirror. The exposure device 6 exposes the respective photoconductors 2 that have been charged by the charging member 3, on the basis of image information formed according to image data for toner of the respective colors. The exposure device 6 is provided so that electrostatic latent images can be formed on the respective photoconductors 2. Electrostatic latent images formed on the photoconductors 2 by this exposure device 6 are developed into visible images by having toner of the respective colors attached thereto when passing by the developing device 4 along with the rotation of the photoconductors 2. Note that toner bottles 20*a*, 20*b*, 20*c*, and 20*d* filled with toner of the respective black, magenta, cyan and yellow colors are arranged in the upper part inside this image forming apparatus 10. Predetermined amounts of toner supply are supplied from the toner bottles 20*a*, 20*b*, 20*c*, and 20*d* through transport routes (not illustrated) to the developing devices 4*a*, 4*b*, 4*c*, and 4*d* of the respective colors.

Furthermore, an endless-belt shaped intermediate transfer belt 7 included as an intermediate transfer body is arranged so as to face these photoconductors 2 in the respective image forming devices, and the photoconductors 2 abut the outer surface of the intermediate transfer belt 7. The intermediate transfer belt 7 illustrated in FIG. 1 is looped around over a plurality of support rollers (for example, support rollers 15*a* and 15*b*). In the illustrated example, the support roller 15*a* is coupled to a drive motor (not illustrated) provided as a drive source. Driving this drive motor causes the intermediate transfer belt 7 to move to rotate counterclockwise in FIG. 1 and also causes the support roller 15*b*, which can be rotated by the rotation, to rotate. Primary transfer rollers 8 positioned so as to face the respective photoconductors 2 with the belt therebetween are arranged on the inner surface of the intermediate transfer belt 7. Primary transfer biases are applied to these primary transfer rollers 8 from a high voltage power supply (not illustrated), so that toner images developed into visible images by the developing devices 4 are primarily transferred to the intermediate transfer belt 7. The cleaning device 5 removes primary transfer residual toner, which has not been primarily transferred and left on the photoconductors 2, to make them ready to perform the next image forming operation, whereby toner on the photoconductors 2 is completely removed.

Furthermore, in the illustrated image forming apparatus 10, a secondary transfer roller 18 is provided as a secondary transfer device downstream of the primary transfer rollers 8 in the direction in which the intermediate transfer belt 7 is driven. This secondary transfer roller 18 faces the support roller 15*b* with the intermediate transfer belt 7 therebetween. A secondary transfer nip part is formed by secondary transfer roller 18 and the support roller 15*b* with the intermediate transfer belt 7 between these rollers. This image forming apparatus 10 further includes a sheet-feeding cassette 30 provided as a recording medium loading unit, a feeding roller 31, and components such as a pair of registration rollers (pair of alignment rollers) 35. Additionally, a fixing device 50 and a pair of sheet ejection rollers 36 are provided downstream of the secondary transfer roller 18 in the direction in which recording media are transported.

Next, the image forming operation is described. In this image forming operation, configurations to form toner images on the respective photoconductors 2 and transfer the toner images onto the intermediate transfer belt 7 are substantially completely the same and differ only in color among the toner images, and thus the suffixes, a, b, c, and d, are omitted as appropriate.

At the start, while each of the above-described photoconductors 2 is driven to rotate clockwise by a drive source (not illustrated), the outer surface of the photoconductor is irradiated with light from a neutralization apparatus (not illustrated) for initialization of the outer surface potential. The outer surface of the photoconductor 2, the outer surface potential of which has been thus initialized, is then uniformly charged to a predetermined polarity by the charging member 3. The charged photoconductor surface is irradiated with a laser beam from the exposure device 6, and an electrostatic latent image is formed on the outer surface of the photoconductor. In this formation, image information that is exposed on the respective photoconductors 2 is pieces of image information each of which corresponds to a single color and is obtained by decomposing a desired full-color image into information for the yellow, cyan, magenta, and black toner colors. Electrostatic latent images thus formed on the photoconductors are visualized as visible toner images by having toner (developer) of the respective colors attached thereto when passing by the developing device 4.

Additionally, the intermediate transfer belt 7 is driven to run counterclockwise in FIG. 1. A primary transfer voltage, which has a polarity opposite to the toner charging polarity that the toner images formed on the photoconductors have, is then applied to each of the above-described primary transfer rollers 8. This voltage application forms a transfer electric field between each of the photoconductors 2 and the intermediate transfer belt 7. The toner images on the photoconductors 2 are then electrostatically primarily transferred onto the intermediate transfer belt 7, which is driven to rotate in synchronization with the photoconductors 2. Thus, the primarily transferred toner images of the respective colors are overlapped on the intermediate transfer belt 7 in a timely manner from the upstream in the transporting direction of the intermediate transfer belt 7, so that a desired full-color image is formed.

On the other hand, a recording medium on which an image is to be formed is fed from a bundle of recording media loaded on the sheet-feeding cassette 30 to the pair of registration rollers 35 while being separated one by one by appropriate operation of an appropriate transport member such as the feeding roller 31. In this feeding stage, the leading end of the transported recording medium hits a nip part of the pair of registration rollers 35 yet to be started to be driven to rotate and then forms what is called a loop. Thus, registration of the recording medium is performed.

Thereafter, the pair of registration rollers 35 are started to be driven to rotate in a timely manner in relation to the full-color toner image born on the intermediate transfer belt 7. The recording medium is then delivered out to the secondary transfer nip part formed by the support roller 15*b* and the secondary transfer roller 18, which faces the support roller 15*b* with the intermediate transfer belt 7 therebetween. In this embodiment, a transfer voltage, the polarity of which is opposite to the toner charging polarity of the toner images on the outer surface of the intermediate transfer belt, is applied to the secondary transfer roller 18. With this voltage application, the full-color toner image formed on the outer surface of the intermediate transfer belt 7 is collectively transferred onto the recording medium.

The recording medium on which the toner image has been transferred is further transported to the fixing device 50. When the recording medium passes through the fixing device 50, heat and pressure are applied thereto whereby the toner image is fixed as a permanent image on the recording medium. The image forming operation is completed when the recording medium after image formation, on which the image is fixed, is ejected onto a recording medium ejection part, such as an ejection tray, through the pair of sheet ejection rollers 36. Note that residual toner, which has been left on the intermediate transfer belt 7 without having been transferred at the secondary transfer nip part where the secondary transfer roller 18 is arranged, is removed and collected by an intermediate transfer belt cleaning device 19.

Figure 2:
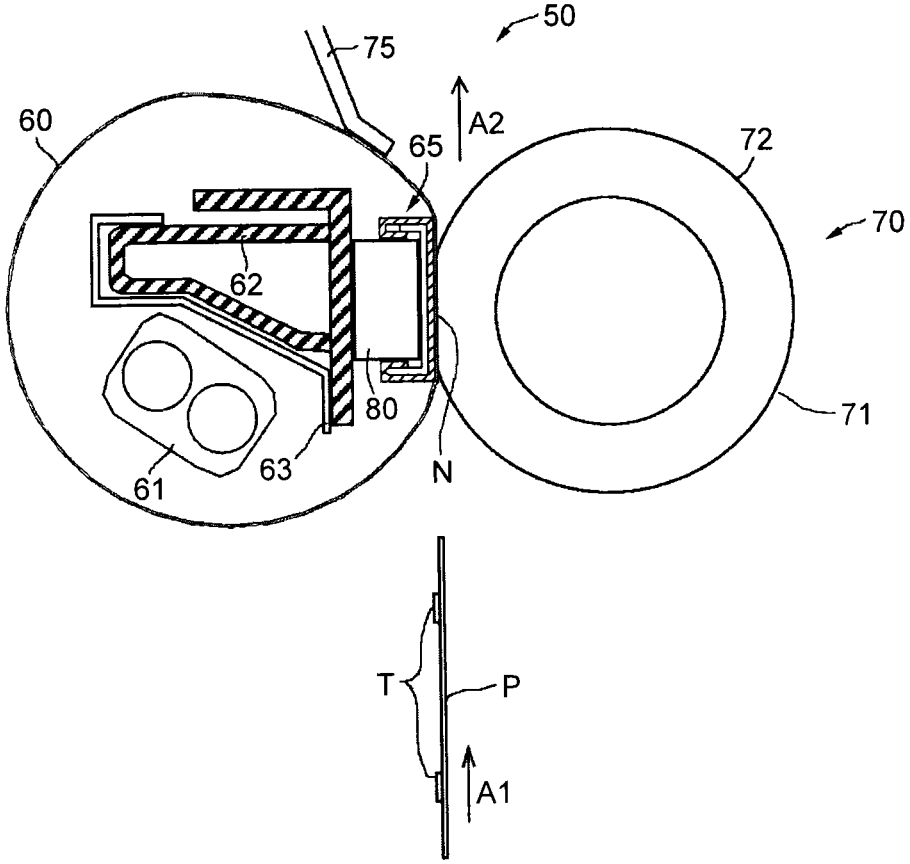
FIG. 2 is a cross-sectional view schematically illustrating a fixing device of the image forming apparatus illustrated in FIG. 1.

Next, the structure of the fixing device 50 is described with reference to FIG. 2. As illustrated in FIG. 2, the fixing device 50 includes: a fixing belt 60 as a rotatable fixing member; a pressure roller 70 rotatably provided, as a pressure member, so as to face the fixing belt 60; a halogen heater 61 as a heat source that heats the fixing belt 60; a nip-forming member 65 disposed inside the fixing belt 60; a support member 62 as a support unit that supports the nip-forming member 65; a reflecting member 63 that reflects light radiated from the halogen heater 61 to the fixing belt 60; a temperature sensor (not illustrated) as a temperature sensor that measures the temperature of the fixing belt 60; and a biasing unit that biases the pressure roller 70 toward the fixing belt 60.

The fixing belt 60 is an endless belt member (examples of which include a film) that is thin and flexible. More specifically, the fixing belt 60 is formed of a base material on the inner circumferential side and a release layer on the outer circumferential side. The base material is formed of a metal material such as nickel or steel use stainless (SUS) or formed of a resin material such as polyimide (PI). The release layer is formed of tetrafluoroethylene-perfluoroalkylvinylether copolymer (PFA) or polytetrafluoroethylene (PTFE), for example. Additionally, an elastic layer formed of a rubber material such as silicone rubber, expandable silicone rubber, or fluorocarbon rubber may be interposed between the base material and the release layer.

The pressure roller 70 includes a cored bar 72, an elastic layer 71 provided on the outer surface of the cored bar 72 and formed of, for example, expandable silicone rubber, silicone rubber, or fluorocarbon rubber, and a release layer (not illustrated) provided on the outer surface of the elastic layer 71 and formed of, for example, PFA or PTFE. The pressure roller 70 is biased toward the fixing belt by the biasing unit (not illustrated) and abuts the nip-forming member 65 with the fixing belt 60 therebetween. At a position at which the pressure roller 70 and the fixing belt 60 make pressure contact with each other, the elastic layer 71 of the pressure roller 70 is compressed so that a nip part (nip) N of a predetermined width is formed. Additionally, the pressure roller 70 is driven to rotate by a drive source such as a motor (not illustrated) provided in the main body of the printer. When the pressure roller 70 is driven to rotate, the drive force is transmitted to the fixing belt 60 at the nip N, so that the fixing belt 60 is driven to rotate by the rotation.

Although a solid roller is employed as the pressure roller 70 in this embodiment, a hollow roller may be employed. In such a case, a heat source such as a halogen heater may be disposed inside the pressure roller 70. If an elastic layer is not provided, the heat capacity is decreased and the fixing quality is increased; however, the possibility of having uneven glossiness in a solid image part arises because, when unfixed toner is compressed to be fixed, minute irregularities of the outer surface of the belt are transferred to an image. In order to prevent this, it is desirable to provide an elastic layer having a thickness of at least 100 μm. Providing an elastic layer having a thickness of at least 100 μm makes it possible to smooth out minute irregularities with elastic deformation of the elastic layer and thus prevents uneven glossiness from occurring. Solid rubber may be used for the elastic layer 71; however, sponge rubber may be used when there no heat source is provided inside the pressure roller 70. Sponge rubber is more desirable because it enhances the heat insulation and thus reduces heat dissipation of the fixing belt 60. Furthermore, an aspect regarding the fixing member and the pressure member is not limited to having these members in pressure contact with each other, and the fixing member and the pressure member can be configured to merely make contact with each other without the application of pressure.

The nip-forming member 65 is disposed in such a manner as to longitudinally extend in the direction along the rotation axis of the fixing belt 60 or in the direction along the rotation axis of the pressure roller 70, and is supported by the support member 62. An end portion of the support member 62 is fixed to a housing (not illustrated) of the fixing device. Thus, deflection of the nip-forming member 65 owing to pressure from the pressure roller 70 can be prevented. As a result, a uniform nip width can be obtained in the direction along the rotation axis of the pressure roller 70. In order to ensure a satisfactory deflection preventing capability to the nip-forming member 65, it is desirable that the support member 62 be formed of a metal material, such as stainless steel or iron, having high mechanical strength. The support member 62 can be made of resin.

The reflecting member 63 is disposed between the support member 62 and the halogen heater 61. In this embodiment, the reflecting member 63 is fixed to the support member 62. It is desirable that the reflecting member 63 be formed of a high-melting point metal material, because this member is directly heated by the halogen heater 61. With the reflecting member 63 thus disposed, light emitted from the halogen heater 61 toward the support member 62 is reflected to the fixing belt 60. Thus, the amount of light with which the fixing belt 60 is irradiated can be increased, and the fixing belt 60 can be efficiently heated. Moreover, transmission of radiant heat from the halogen heater 61 to the support member 62 and other members can be suppressed, and the energy efficiency is therefore improved.

Note that, instead of providing the reflecting member 63 like the one of this embodiment, a reflecting surface may be formed by processing a surface of the support member 62 that faces the halogen heater 61 into a mirror surface by polishing or coating the surface. It is desirable that the reflecting surface of the above-described reflecting member 63 or support member 62 has a reflectivity of at least 90%.

There are limited choices of the shape and the material of the support member 62 because it is needed to ensure the strength thereof. Thus, separately providing the reflecting member 63 as in this embodiment allows greater flexibility in choices of the shape and the material, and the reflecting member 63 and the support member 62 can be dedicated to their respective functions. Additionally, providing the reflecting member 63 between the halogen heater 61 and the support member 62 makes the halogen heater 61 and the reflecting member 63 closer to each other, thereby making it possible to efficiently heat the fixing belt 60.

Figure 3A:
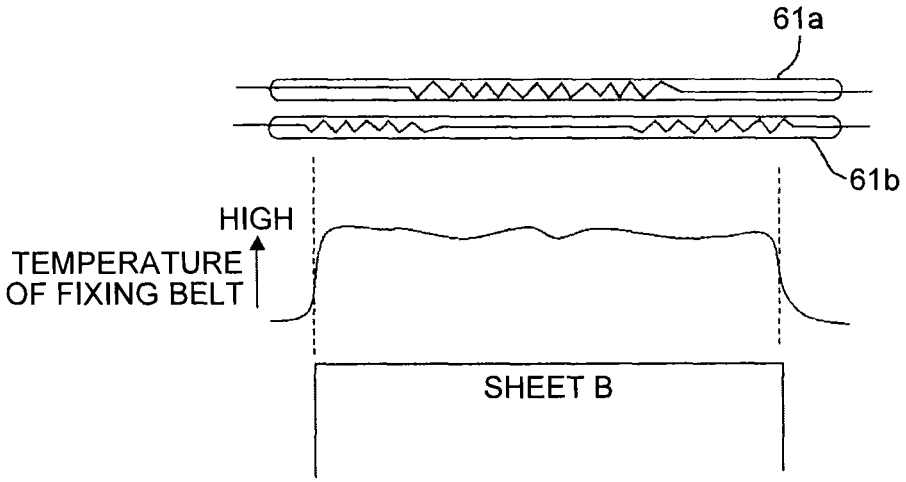
FIGS. 3A and 3B are illustrations explaining a halogen heater for use in the image forming apparatus illustrated in FIG. 1.
Figure 3B:
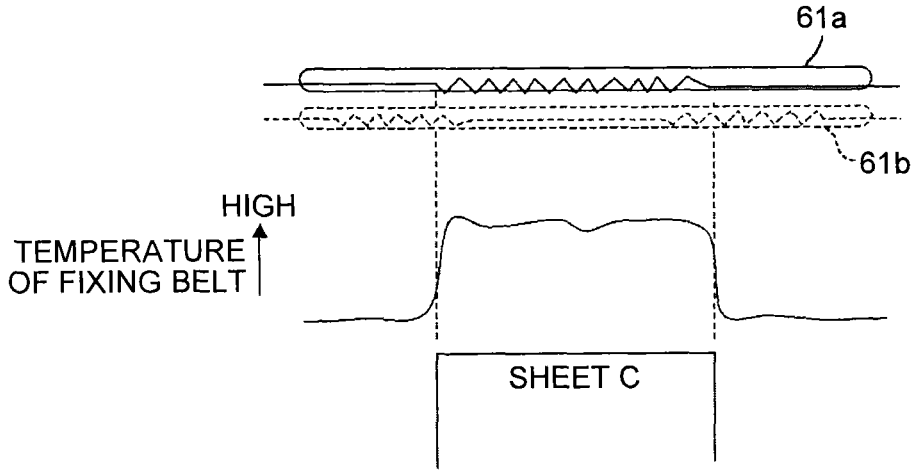

Two halogen heaters 61 are used as illustrated in FIGS. 3A and 3B. These two halogen heaters 61 are provided with different heating ranges. The halogen heaters 61 are capable of heating the fixing belt 60 in accordance with the size of a sheet that passes through the fixing device 50. Specifically, the fixing device 50 in this embodiment includes the following two heaters: a centered heater 61*a* that heats a location corresponding to the longitudinally central region of the fixing belt 60; and an end heater 61*b* that heats locations corresponding to the longitudinally end regions of the fixing belt 60. As illustrated in FIG. 3A, when a wide sheet B such as a portrait-oriented A3-size sheet passes, both the centered heater 61*a* and the end heater 61*b* are turned on. On the other hand, as illustrated in FIG. 3B, when a narrow sheet C such as a portrait-oriented A4-size sheet passes, only the centered heater 61*a* is turned on. Thus, power consumption for heating the fixing belt 60 can be reduced. Although the two halogen heaters 61 are used in this embodiment, embodiments are not limited to this aspect.

Although omitted from the drawings, a shield member that partially blocks heat emitted from the halogen heater 61 may be disposed between the fixing belt 60 and the halogen heater 61 (for example, an end portion in the axial direction). This shield member makes it possible to prevent the temperature of a no-sheet passing region on the fixing belt 60 from excessively increasing, particularly when sheets continuously pass, and further makes it possible to protect the fixing belt 60 from deterioration and damage due to heat.

Next, basic operations of the fixing device according to this embodiment are described. When the power switch of the printer is turned on, power is supplied to the halogen heater 61 and, at the same time, the pressure roller 70 starts to be driven to rotate-clockwise in FIG. 2. Thus, the fixing belt 60 is driven to rotate counterclockwise in FIG. 2 by the rotation because of the frictional force between the fixing belt 60 and the pressure roller 70.

Thereafter, a sheet P bearing an unfixed toner image T as a result of the above-described image forming process is guided by a guide plate (not illustrated) to be transported in the direction of the arrow A1 in FIG. 2 and fed into the nip N formed by the fixing belt 60 and the pressure roller 70, which are in pressure contact with each other. Subsequently, the toner image T is fixed to the outer surface of the sheet P with both heat and pressure, where, while the heat is applied from the fixing belt 60 heated by the halogen heater 61, the pressure is applied from the fixing belt 60 and the pressure roller 70.

The sheet P having the toner image T fixed thereon is delivered out from the nip N in the direction of the arrows in FIG. 2. In this process, the sheet P is separated from the fixing belt 60 by having the leading end of the sheet P in contact with the tip of the separation member 75. Thereafter, the separated sheet P, as described above, is ejected to the outside of the apparatus to be stocked onto a sheet ejection tray by the action of the ejection rollers.

Figure 4:
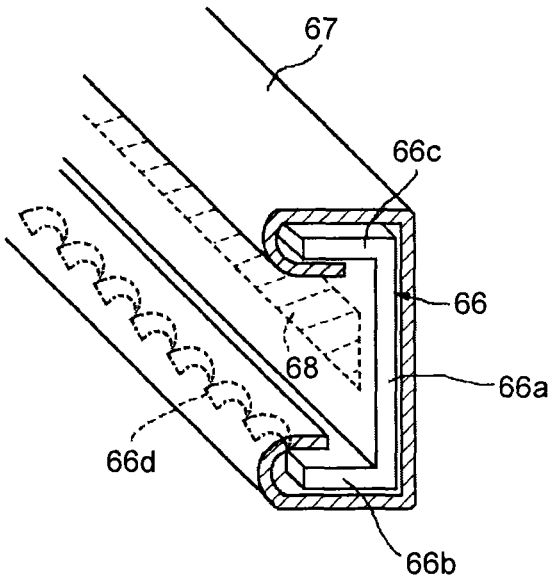
FIG. 4 is an exploded perspective view explaining a nip-forming member of the image forming apparatus illustrated in FIG. 1.

Next, the nip-forming member 65 that is characteristic in the present invention is described. As illustrated in FIG. 4, the nip-forming member 65 includes: a heat-averaging member 66 as a first heat transmission unit; and a sliding sheet 67 provided on the heat-averaging member 66. When the fixing belt 60 rotates, the fixing belt 60 slides over this sliding sheet 67. This configuration reduces the driving torque of the fixing belt 60 and the load acting on the fixing belt 60 due to frictional force.

The heat-averaging member 66 is formed of, for example, a material having high thermal conductivity, such as copper, and is formed over the longitudinal direction of the fixing belt 60. The heat-averaging member 66 absorbs heat excessively accumulated at the no-sheet passing portion of the fixing belt 60, and transmits the heat in the longitudinal direction.

The heat-averaging member 66 includes: an abutment part 66*a* that abuts the fixing belt 60 with the sliding sheet 67 therebetween; and a bent part 66*b* and a bent part 66*c* formed at the upstream and the downstream of the nip N in the transport direction of the sheet P so as to extend inside the fixing belt 60.

Figure 5A:
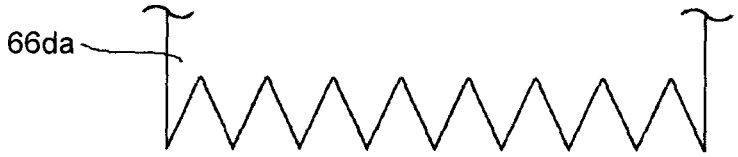
FIGS. 5A to 5E are illustrations explaining the nip-forming member of the image forming apparatus illustrated in FIG. 1.
Figure 5B:
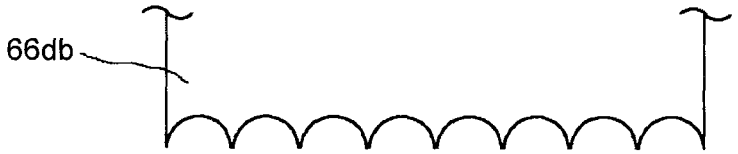
Figure 5C:
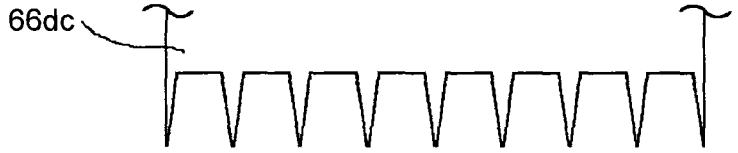
Figure 5D:
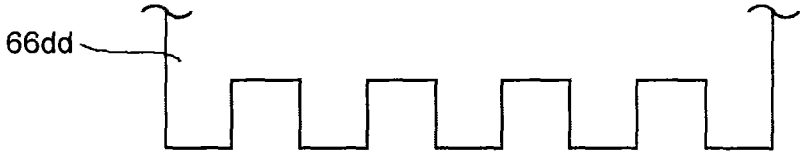
Figure 5E:
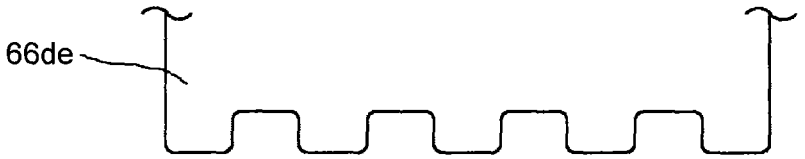

At the tip of the bent part 66*b* at the upstream of the nip N in the direction of rotation of the fixing belt 60, a retaining part 66*d* that catches and retains the sliding sheet 67 is included. Various aspects can be applied to this retaining part 66*d* as a first acute part. A first retaining part 66*da* has an acute chevron-edge shape as illustrated in FIG. 5A. A second retaining part 66*db* has a wavy-edge shape as illustrated in FIG. 5B. A third retaining part 66*dc* has a shape of a plurality of needles as illustrated in FIG. 5C. A fourth retaining part 66*dd* has a shape of a plurality of rectangular projections as illustrated in FIG. 5D. A fifth retaining part 66*de* has a shape of a plurality of projections with rounded corners as illustrated in FIG. 5E.

Thus, when the fixing belt 60 rotates, the retaining part 66*d* retains the sliding sheet 67, and the nip N can be appropriately formed even if the sliding sheet 67 is pulled in the sliding direction of the fixing belt 60. Each of the first to the third retaining parts 66*d* is formed of a plurality of acute projections, and, as long as the nip N is appropriately formed, the projections may or may not penetrate the sliding sheet 67; however, the retention force that acts against tension due to the rotation is larger with the retaining part penetrating the sliding sheet 67.

Figure 6:
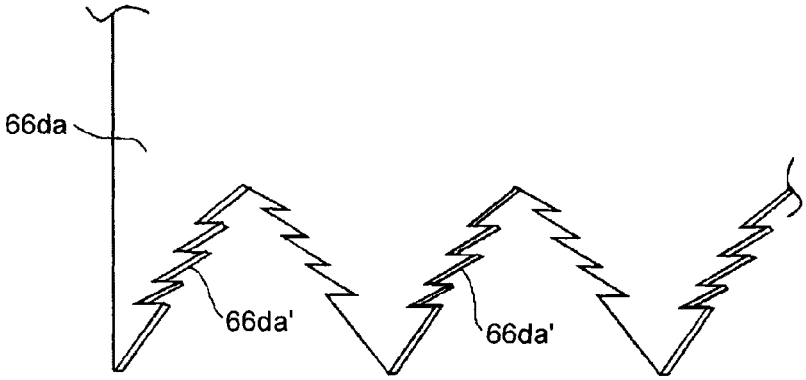
FIG. 6 is an illustration explaining the nip-forming member of the image forming apparatus illustrated in FIG. 1.

Alternatively, the retaining part 66*d* may further include, in the first acute part, second acute parts as parts having an acute shape. For example, acute chevron-edge shaped parts 66*da*' may be included as the second acute parts on the tip surface of the first retaining part 66*da* as the first acute part, as illustrated in FIG. 6. It is desirable that the acute chevron-edge shaped parts 66*da*' have a shape of a barb to prevent the caught sliding sheet 67 from coming off. Providing the retaining part 66*d* with the second acute parts in addition to the first acute part makes it possible that, when the retaining part 66*d* has penetrated the sliding sheet 67, the second acute parts can catch and retain the sliding sheet 67. The second acute parts are not limited to this aspect, and various shapes as in the case of the first acute part can be applied.

Figure 7A:
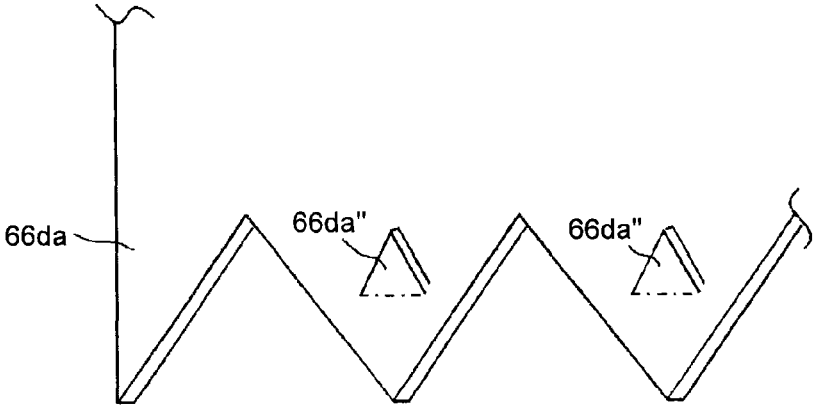
FIGS. 7A and 7B are illustrations explaining the nip-forming member of the image forming apparatus illustrated in FIG. 1.
Figure 7B:
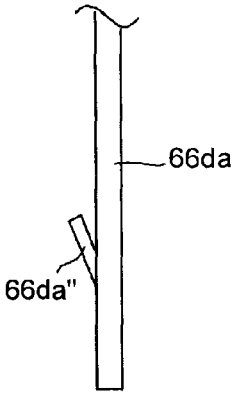

Alternatively, the retaining part 66*d* may further include, in the first acute part, third acute parts as parts having an acute shape. For example, acute chevron-edge shaped parts 66*da*" may be included as the third acute parts as illustrated in FIG. 7A and FIG. 7B, on one side surface of the first retaining part 66*da* as the first acute part, i.e., on a surface of the bent part 66*b* that faces one surface of the bent part 66*c*. It is desirable that the acute chevron-edge shaped parts 66*da*" have a shape of a barb to prevent the caught sliding sheet 67 from coming off. Providing the retaining part 66*d* with the third acute parts in addition to the first acute part makes it possible that, when the retaining part 66*d* has penetrated the sliding sheet 67, the third acute parts can catch and retain the sliding sheet 67. The third acute parts are not limited to this aspect, and various shapes as in the case of the first acute part can be applied. Obviously, the third acute parts are provided at locations such that workability in attaching a retaining unit described later is not impaired.

Figure 8:
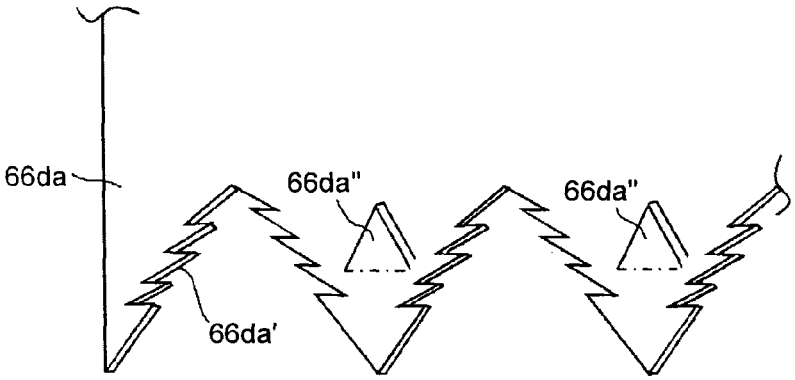
FIG. 8 is an illustration explaining the nip-forming member of the image forming apparatus illustrated in FIG. 1.

Alternatively, the retaining part 66*d* may further include, in the first acute part, the second acute parts and the third acute parts as parts having an acute shape. For example, the acute chevron-edge shaped parts 66*da*' and the acute chevron-edge shaped parts 66*da*" may be included, as the second acute parts and as the third acute parts on the tip surface of the first retaining part 66*da* as the first acute part and on a side surface of the first retaining part 66*da* as the first acute part, respectively, as illustrated in FIG. 8. The side surface is a surface of the bent part 66*b* that faces one surface of the bent part 66*c*. It is desirable that the acute chevron-edge shaped parts 66*da*' and 66*da*" have a shape of a barb to prevent the caught sliding sheet 67 from coming off. Providing the retaining part 66*d* with the second acute parts and the third acute parts in addition to the first acute part makes it possible that, when the retaining part 66*d* has penetrated the sliding sheet 67, the second acute parts and the third acute parts can catch and retain the sliding sheet 67. The second acute parts and the third acute parts are not limited to this aspect, and various shapes as in the case of the first acute part can be applied. Obviously, the third acute parts are provided at locations such that workability in attaching a retaining unit described later is not impaired.

Figure 9:
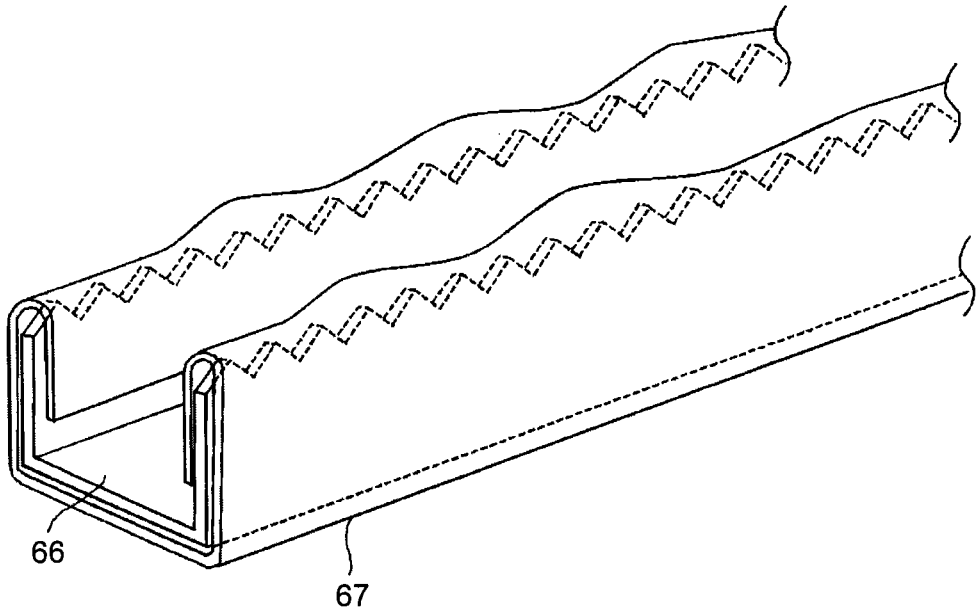
FIG. 9 is a perspective view explaining the nip-forming member of the image forming apparatus illustrated in FIG. 1.

There is one inconvenience involved with the acute projections being arranged in the longitudinal direction of the heat-averaging member 66 at regular intervals. As illustrated in FIG. 9, the sliding sheet 67 may sag when the sliding sheet 67 is caught and retained by the retaining part 66*d*. In such a case, it is more likely that the sliding sheet 67 comes off from the retaining part 66*d*, because the sliding sheet 67 is caught by the retaining part 66*d* at positions of the sliding sheet 67 that are relatively near the edge thereof.

Figure 10:
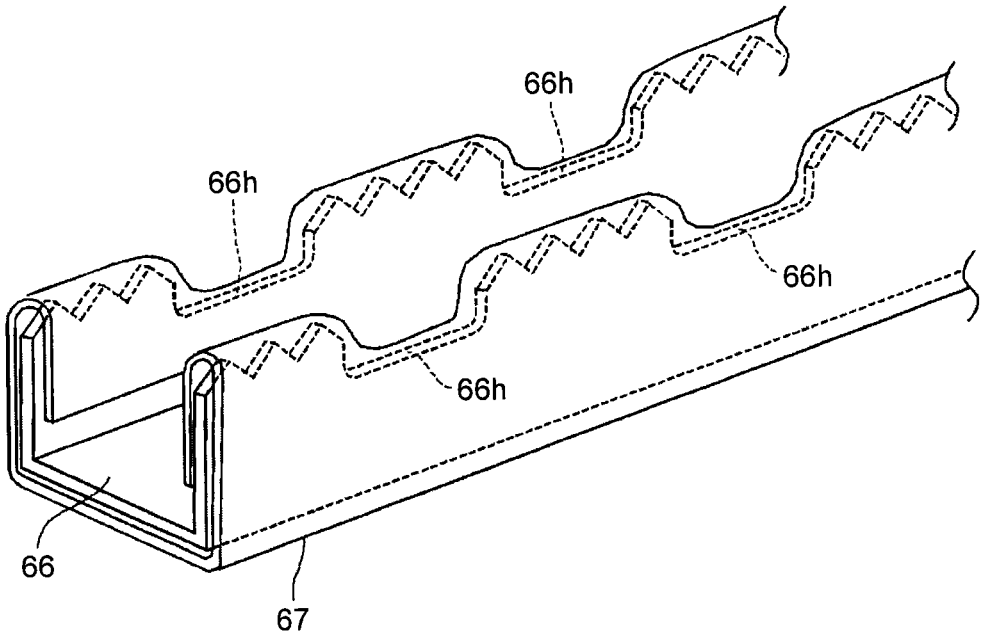
FIG. 10 is a perspective view explaining the nip-forming member of the image forming apparatus illustrated in FIG. 1.
Figure 11A:
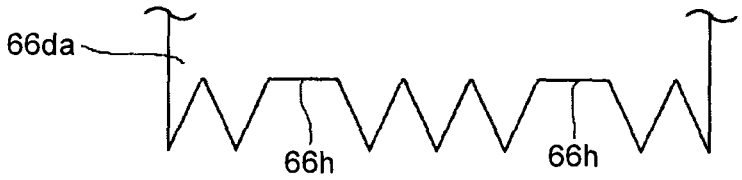
FIGS. 11A to 11E are illustrations explaining the nip-forming member of the image forming apparatus illustrated in FIG. 1.
Figure 11B:
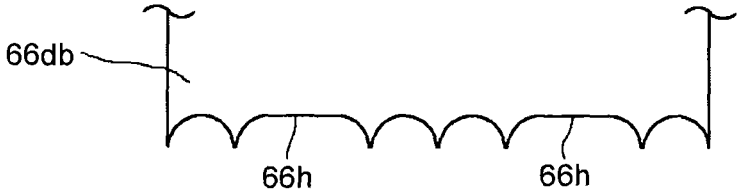
Figure 11C:
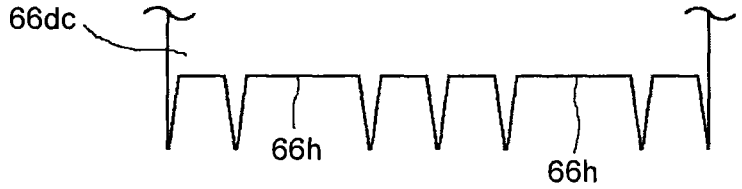
Figure 11D:
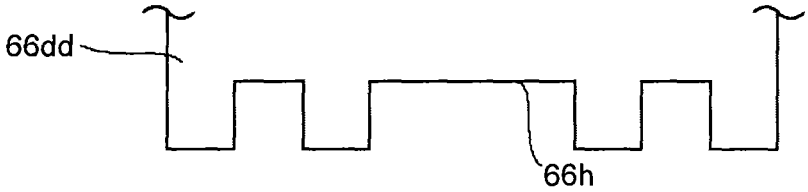
Figure 11E:
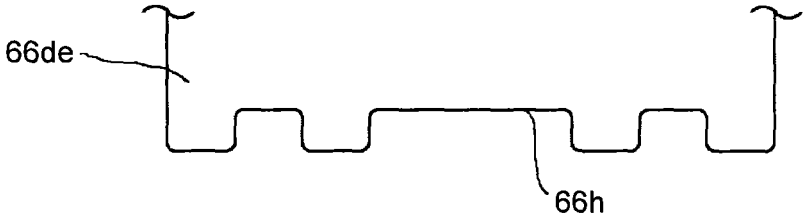

To eliminate this inconvenience, the acute projections may not be arranged in the longitudinal direction of the heat-averaging member 66 at regular intervals. For example, recesses 66*h* may be provided to the retaining part 66*d* so that the acute projections are arranged at intervals that are partially widened, as illustrated in FIG. 10. Specifically, for example, when the recesses 66*h* are provided in the first retaining part 66*da*, the first retaining part 66*da* has a shape formed of chevron-edge shaped parts and the recesses 66*h* each interposed between neighboring ones of the chevron edge shaped parts, as illustrated in FIG. 11A. When the recesses 66*h* are provided in the second retaining part 66*db*, the second retaining part 66*db* has a shape formed of wavy-edge shaped parts and the recesses 66*h* each interposed between the wavy-edge shaped parts, as illustrated in FIG. 11B. When the recesses 66*h* are provided in the third retaining part 66*dc*, the third retaining part 66*dc* has a shape formed of the needle shaped parts and the recesses 66*h* each interposed between appropriate ones of the needle shaped parts, as illustrated in FIG. 11C. When the recesses 66*h* are provided in the fourth retaining part 66*dd*, the fourth retaining part 66*dd* has a shape formed of the angular projections and the recesses 66*h* each interposed between appropriate ones of the angular projections, as illustrated in FIG. 11D. When the recesses 66*h* are provided in the fifth retaining part 66*de*, the fifth retaining part 66*de* has a shape formed of the projections with rounded corners and the recesses 66*h* interposed between appropriate ones of the projections with rounded corners, as illustrated in FIG. 11E.

When any one of the above configurations is employed, parts of the sliding sheet 67 that are placed over the recesses 66*h* of the retaining part 66*d* are pushed in the recesses 66*h* with a rod included in a jig, for example. Thus, sagging of the sliding sheet 67 is eliminated. As a result, the sliding sheet 67 can be retained while being prevented from coming off from the retaining part 66*d*.

Figure 12A:
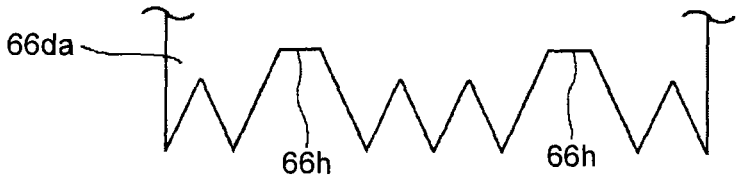
FIGS. 12A to 12E are illustrations explaining the nip-forming member of the image forming apparatus illustrated in FIG. 1.
Figure 12B:
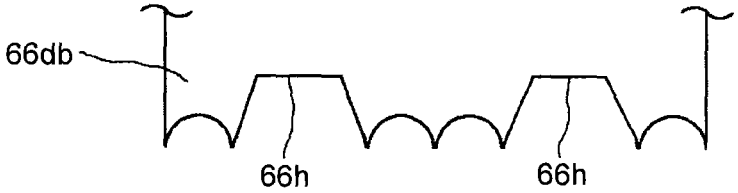
Figure 12C:
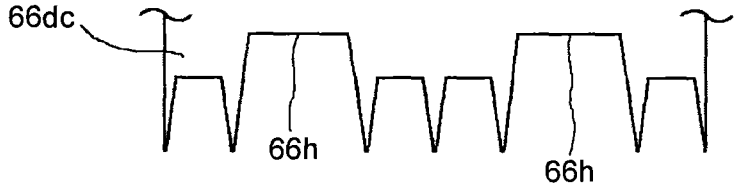
Figure 12D:
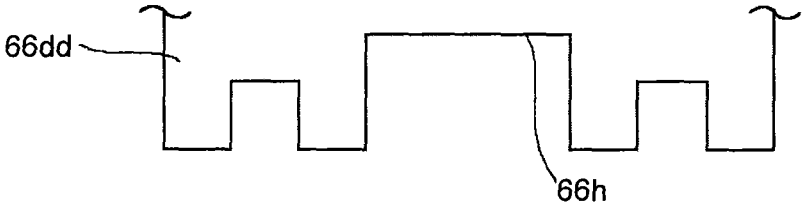
Figure 12E:
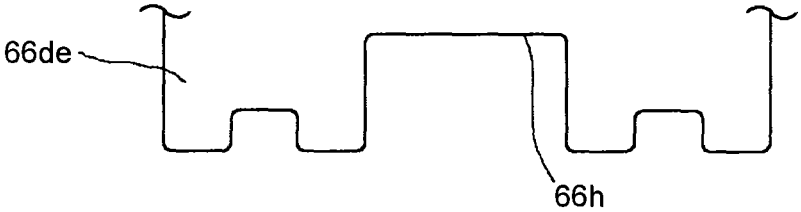

It is desirable that bottoms forming the respective recesses 66*h* be located closer to the nip than the bottoms (bases) of the acute projections. In other words, it is desirable that the depth of valleys that correspond to the recesses 66*h* be deeper than the depth of valleys between adjacent ones of the projections. Specifically, for example, when the first retaining part 66*da* includes the recesses 66*h*, bottoms forming the recesses 66*h* are located closer to the nip than the bottoms (bases) of the chevron-edge shaped parts, as illustrated in FIG. 12A. When the second retaining part 66*db* includes the recesses 66*h*, bottoms forming the recesses 66*h* are located closer to the nip than the bottoms (bases) of the wavy-edge shape, as illustrated in FIG. 12B. When the third retaining part 66*dc* includes the recesses 66*h*, bottoms forming the recesses 66*h* are located closer to the nip than the bottoms (bases) of the needle shaped parts, as illustrated in FIG. 12C. When the fourth retaining part 66*dd* includes the recesses 66*h*, bottoms forming the recesses 66*h* are located closer to the nip than as the bottoms (bases) of the angular projections, as illustrated in FIG. 12D. When the fifth retaining part 66*de* includes the recesses 66*h*, bottoms forming the recesses 66*h* are located closer to the bottoms (bases) of the projections with rounded corners, as illustrated in FIG. 12E.

When the valleys of the recesses 66*h* are formed deeper than the valleys between adjacent ones of the acute projections, the sliding sheet 67 can be retained with sagging of the sliding sheet 67 being absorbed.

The number of recesses 66*h* included in the retaining part 66*d* may be one in one aspect, and may be two or more in another aspect. Additionally, the shape of the retaining part 66*d* is not limited to these aspects, and any shape is satisfactory as long as the tip thereof catches and retains the sliding sheet 67. Although the retaining part 66*d* in this embodiment is formed in the bent part 66*b* at the upstream of the nip N in the transport direction of the sheet P, the retaining part 66*d* may be additionally included in the tip of the bent part 66*c* at the downstream of the nip N in the transport direction of the sheet P. With the retaining part 66*d* included in the tip of the bent part 66*c*, the sliding sheet 67 can be retained and the nip N is appropriately formed even when the sliding sheet 67 is pulled in the sliding direction thereof due to reverse rotation of the fixing belt 60.

Although the bent parts 66*b* and 66*c* in this embodiment are formed by being bent at right angles with respect to an abutting part 66*a*, embodiments are not limited to this aspect. The bent parts 66*b* and 66*c* may be formed by being bent at acute angles, or may be formed by being curved. Alternatively, the bent part may be provided only at the upstream of the nip N in the transport direction of the sheet P.

Figure 13A:
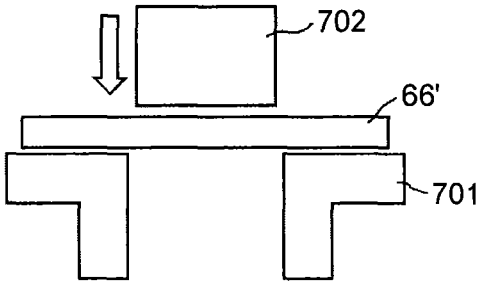
FIGS. 13A and 13B are illustrations explaining a heat-averaging member of the image forming apparatus illustrated in FIG. 1.
Figure 13B:
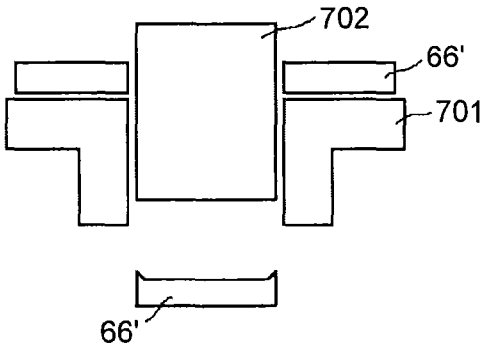

The heat-averaging member 66 is formed by performing a shearing process and a folding process on a flat plate 66'. In the shearing process, as illustrated in FIG. 13A and FIG. 13B, the flat plate 66' is inserted between a punch 702 and a die 701 and pressurized with them, so that the flat plate 66' is sheared with the edges of the punch 702 and the die 701. Burrs 90 are inevitably generated on one surface of a piece sheared out from the flat plate 66'. Such burrs are usually removed by, for example, polishing to ensure the safety of manufacturers and prevent damages to the other components.

Figure 14A:
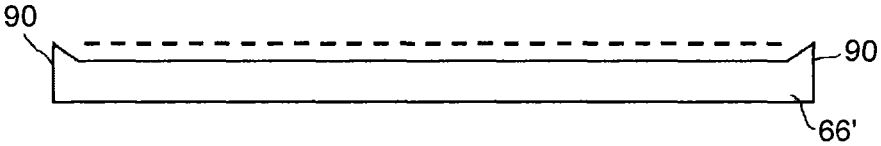
FIGS. 14A and 14B are illustrations explaining the heat-averaging member of the image forming apparatus illustrated in FIG. 1.
Figure 14B:
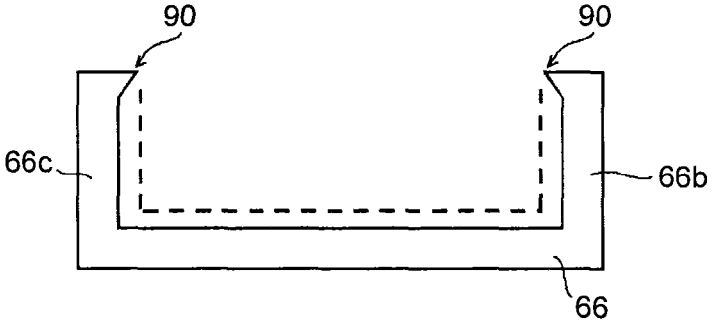

The heat-averaging member 66 according to this embodiment may be subjected to the folding process while the burrs 90 generated on the piece sheared out from the flat plate 66' are left as they are. Specifically, the bent parts 66*b* and 66*c* are obtained by valley fold of the piece sheared out from the flat plate 66' such that the side thereof having the burrs 90, which is indicated by the dotted lines in FIG. 14A and FIG. 14B, form the inside of the valley. Thus, the burrs 90 project from the tips of the bent parts 66*b* and 66*c* toward inside the heat-averaging member 66. "Toward inside the heat-averaging member 66" refers to toward a side, out of the two sides defining the thickness of the flat plate 66' in a corresponding one of the bent parts 66*b* and 66*c*, that is closer to the nip N than the other side when the heat-averaging member 66 is mounted on the fixing device 50. In other words, "toward inside the heat-averaging member 66" refers to toward a side that faces a later-described first retaining unit 80 in a state where the first retaining unit 80 is mounted on the heat-averaging member 66. In other words, "toward inside the heat-averaging member 66" refers to toward a side that faces an end region of the sliding sheet 67 in a state where the sliding sheet is caught by the bent parts 66*b* and 66*c*. In still other words, "toward inside the heat-averaging member 66" refers to toward a side closer to an end of the sliding sheet 67 between the side and the first retaining unit 80 in a state where the first retaining unit 80 and the sliding sheet 67 are mounted on the heat-averaging member 66. The burrs 90 of the heat-averaging member 66 formed in this way act as protruding parts serving as fourth acute parts in the retaining part 66*d*.

When the retaining part 66*d* of the heat-averaging member 66 includes the protruding parts 90 as the fourth acute parts, the protruding parts 90 catch the sliding sheet 67 and can retain the sliding sheet 67. In the heat-averaging member 66, the protruding parts 90 as the fourth acute parts may be formed in addition to the above-described first acute part, second acute parts, or third acute parts, which are described above, or a combination of these parts. Even in a configuration having the protruding parts 90 in the retaining part 66*d*, the retaining part 66*d* can include the recess 66*h*.

Figure 15:
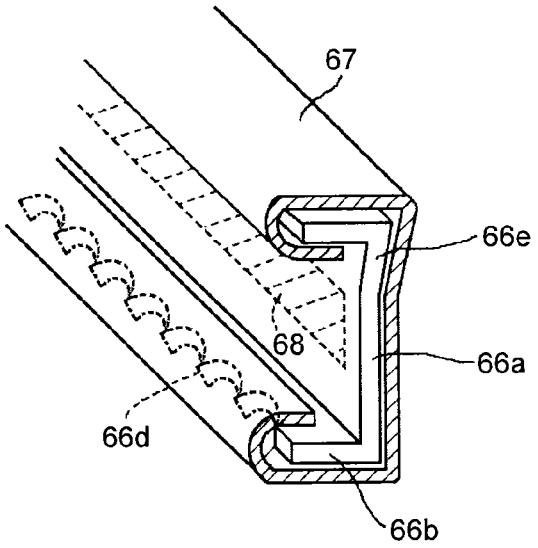
FIG. 15 is an exploded perspective view explaining the nip-forming member of the image forming apparatus illustrated in FIG. 1.

The heat-averaging member 66 is not limited to the above-described embodiment, and a salient portion 66*e* protruding toward the pressure roller 70 may be formed, as a protrusion, at the downstream of the nip N in the transport direction of the sheet P, as illustrated in FIG. 15. This salient portion 66*e* protrudes while forming a smooth surface from the abutting part 66*a*. Thus, the sheet P after the fixing at the nip N can rise from the fixing belt 60, and separability is improved.

Figure 16:
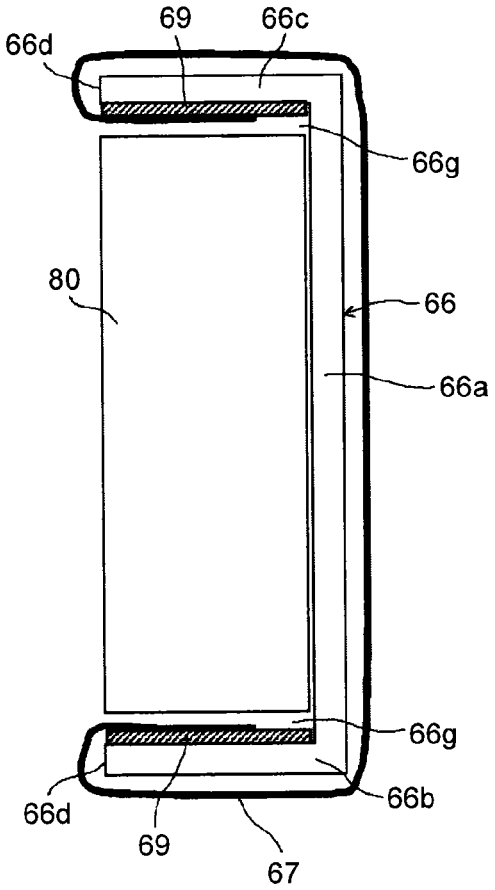
FIG. 16 is a cross-sectional view explaining the nip-forming member of the image forming apparatus illustrated in FIG. 1.

Alternatively, as illustrated in FIG. 16, the heat-averaging member 66 may retain the sliding sheet 67 by double-faced adhesive tape 68 therebetween. Using the double-faced adhesive tape to retain parts of the sliding sheet 67 and the heat-averaging member 66 by each other makes it possible to have the sliding sheet 67 easily caught and retained by the retaining part 66*d*, resulting in improved workability. Using the tape also makes it possible to appropriately form the nip N by allowing the sliding sheet 67 to be retained more strongly against force that pulls the sliding sheet 67 in the sliding direction thereof. Embodiments are not' limited to the aspect of using double-faced adhesive tape, and adhesive may be applied instead.

The fixing belt 60 passes the nip N while sliding over the sliding sheet 67, and the fixing belt 60 needs to reduce friction of this sliding portion and suppress torque for the fixing device. For this reason, a method of impregnating the sliding sheet 67 with silicone oil has been employed.

Figure 26:
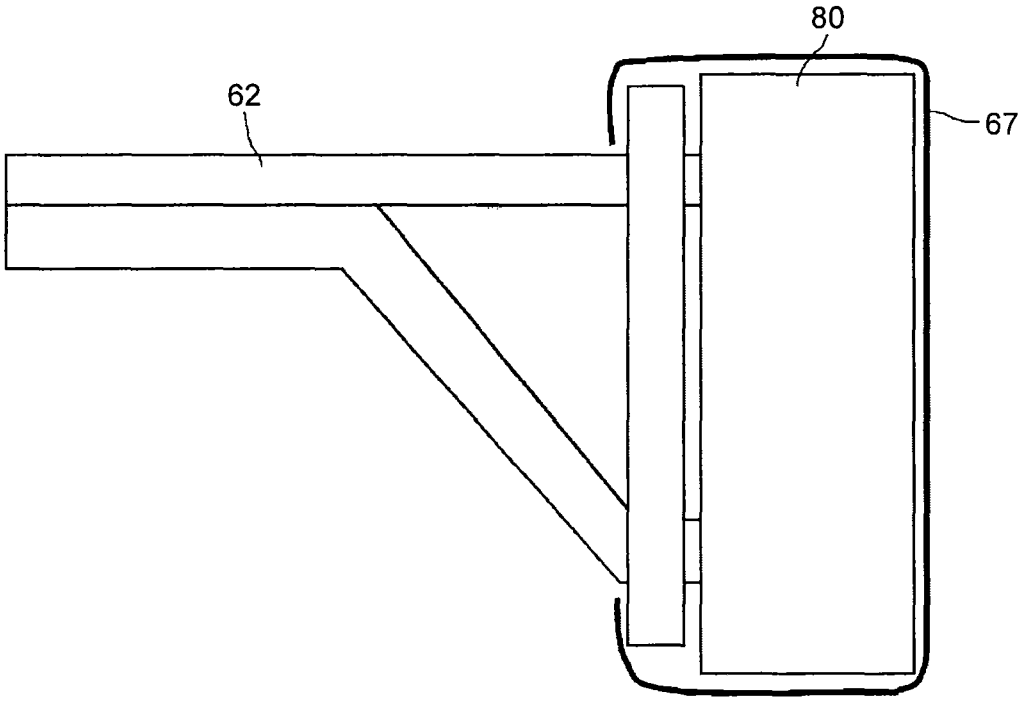
FIG. 26 is an illustration explaining a sliding sheet in a related art.
Figure 27:
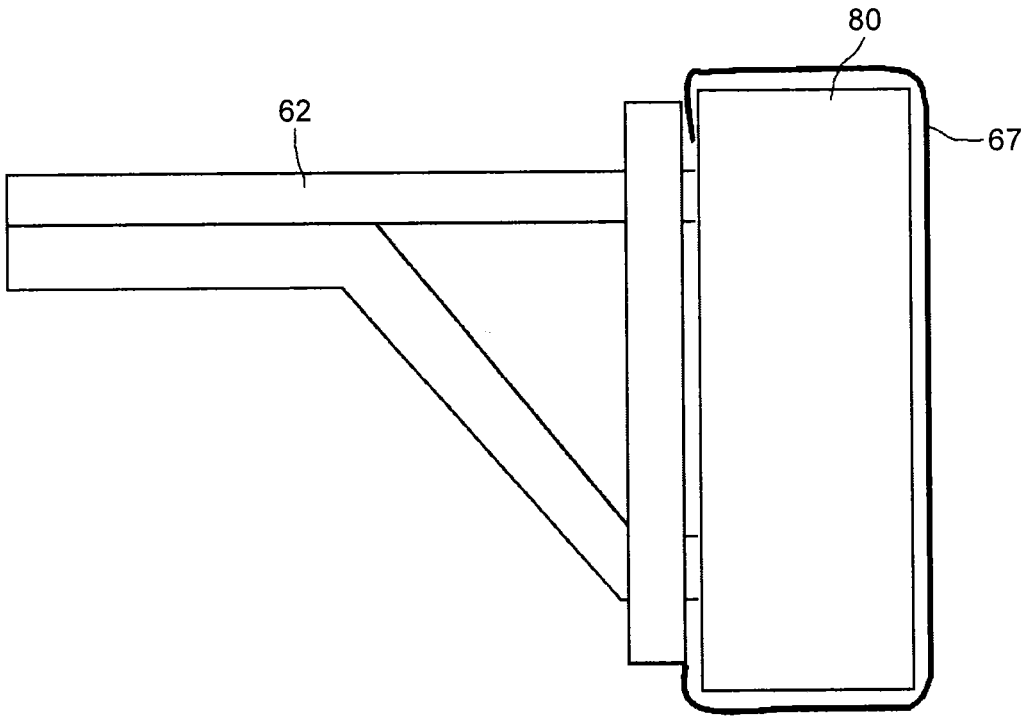
FIG. 27 is an illustration explaining another sliding sheet in a related art.

If the amount of the silicone oil is not sufficient, silicone oil runs out and the sliding sheet is worn away, resulting in a shorter life of the fixing device. On the other hand, if the amount of silicone oil is excessive, there is a risk that silicone oil leaks from the sliding sheet along another member such as, for example, the support member 62, as illustrated in FIG. 26. Additionally, as illustrated in FIG. 27, when a tip of the sliding sheet faces vertically downward, there is a risk that an excess of silicone oil drips off.

In order to overcome such disadvantages, strict control over the amount of silicone oil with which the sliding sheet is impregnated has been needed so that silicone oil can be kept from leaking and improvement has therefore been called for.

The sliding sheet 67 in this embodiment is not configured to be fastened to any other components, and thus the antifriction does not flow out along the sliding sheet even when the sliding sheet 67 is impregnated with silicone oil. Thus, the durability of the sliding sheet 67 and the durability of the fixing belt 60 can be sustained.

Note that a tip of the sliding sheet 67 folded back at the retaining part 66*d* may have a space (gap) 66*g* between itself and the back surface of the abutting part 66*a*, as illustrated in FIG. 16. When the sliding sheet 67 is pressed at the nip N, an excess of silicone oil can escape to the space 66*g*. Thus, the amount of silicone oil with which the sliding sheet 67 is impregnated can be increased, whereby the fixing device can have a longer life.

Additionally, the sliding sheet 67 that is folded back at the retaining part 66*d* may be bonded to each of the bent parts 66*b* and 66*c* by double-faced adhesive tape 69 therebetween. Embodiments are not limited to the aspect in which double-faced adhesive tape is used, and adhesive may be applied instead.

There is an issue involved when the sliding sheet 67 is caught and retained by the retaining part 66*d*, which is that the sliding sheet 67 has toughness and has strength to return to the original shape, resulting in poor attachment workability.

Figure 17:
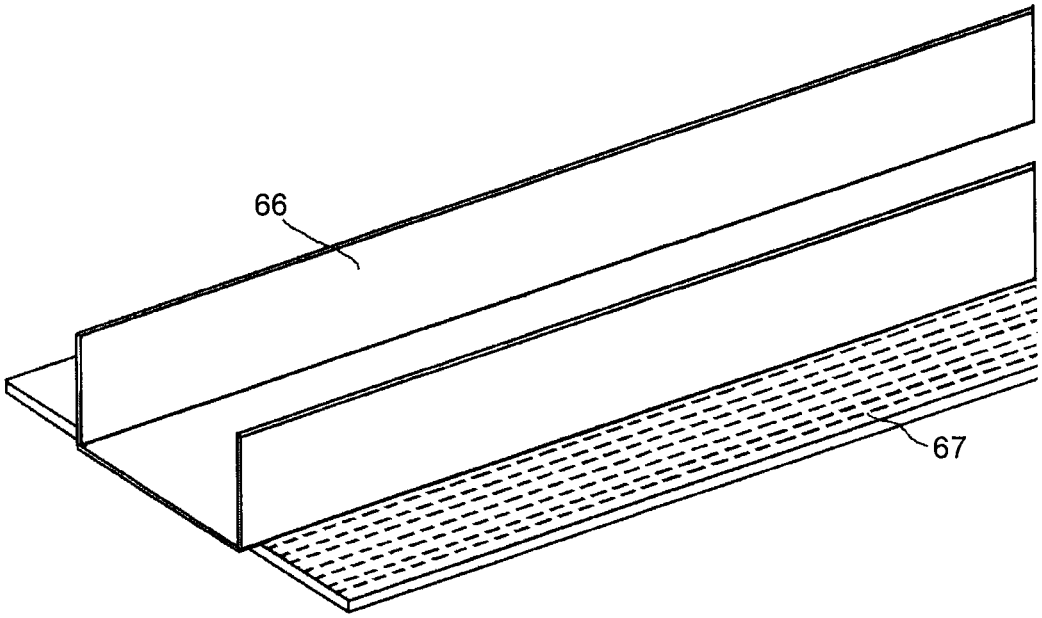
FIG. 17 is an illustration explaining a sliding sheet of the image forming apparatus illustrated in FIG. 1.

In order to overcome such a disadvantage in attachment workability, a plurality of creases may be formed in the sliding sheet 67 in parallel to the longitudinal direction of the heat-averaging member 66 to which the sliding sheet 67 is attached, as illustrated in FIG. 17. These creases are formed, for example, with an iron before the sliding sheet 67 is attached to the heat-averaging member 66. Forming creases in the sliding sheet 67 in this way improves attachment workability when the sliding sheet 67 is attached to the heat-averaging member 66. Such formation of creases also improves attachment precision, thereby resulting in a higher capability of retaining the sliding sheet 67.

Note that, when texture on the sliding surface of the sliding sheet 67 is not parallel to the longitudinal direction of the heat-averaging member 66 for a reason for increasing the slidability or the like, the sliding sheet 67 may have a double structure where texture in parallel to the longitudinal direction of the heat-averaging member 66 are formed only on the non-sliding surface side.

In order to further securely fix the sliding sheet 67, a retaining unit that retains the sliding sheet 67 and the heat-averaging member 66 may be provided. Hereinafter, retaining units of various aspects are described. Two or more of the following retaining units may be implemented in combination.

First, a first retaining unit is described.

Figure 18:
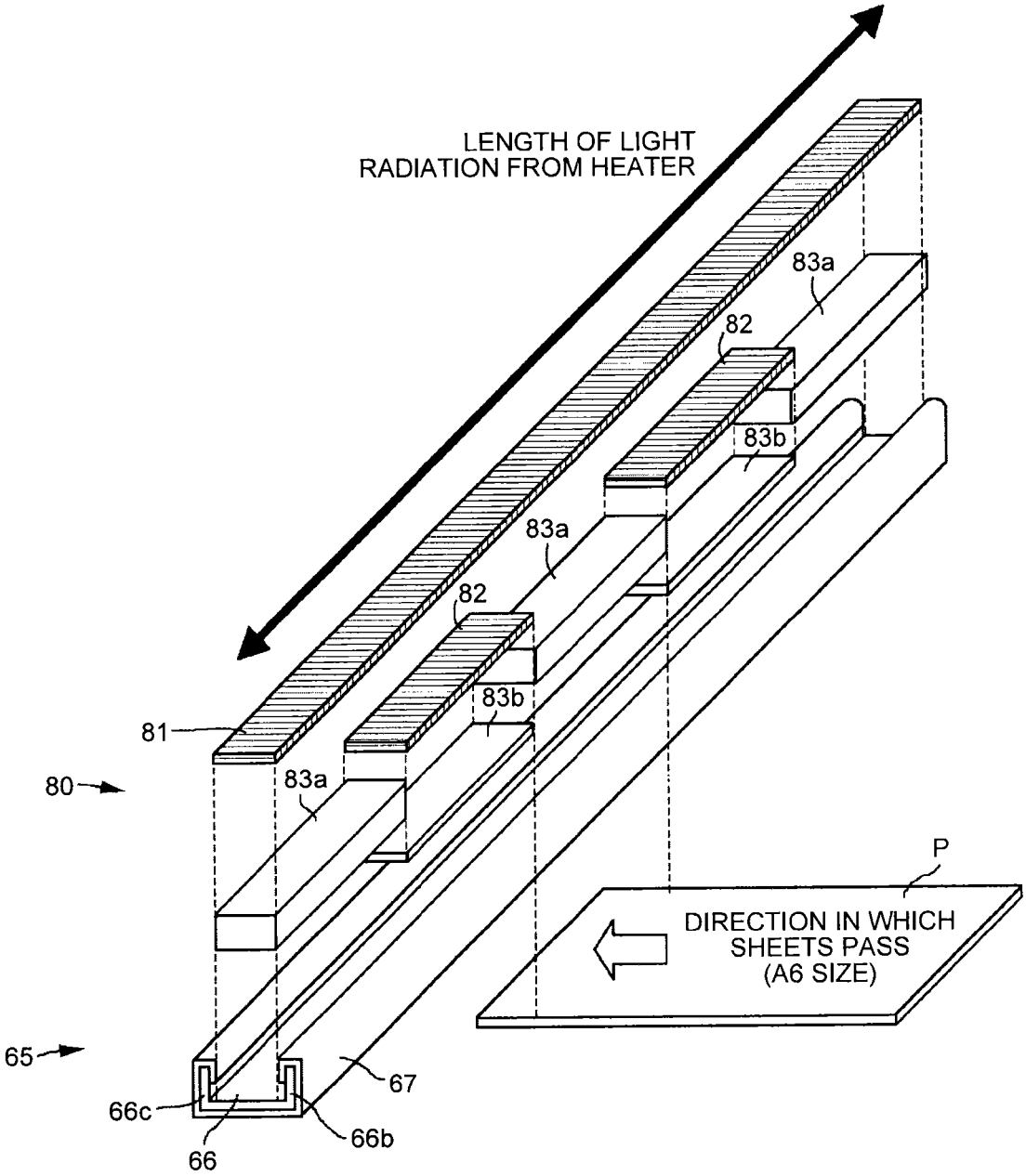
FIG. 18 is an exploded perspective view explaining a first retaining unit of the image forming apparatus illustrated in FIG. 1.

The first retaining unit 80 includes, for example, first heat insulating members 83*a* and second heat insulating members 83*b* as second heat transmission units, first heat absorbing members 82 as third heat transmission units, and a second heat absorbing member 81 as a fourth heat transmission unit, as illustrated in FIG. 18. The first retaining unit 80 is supported by the support member 62.

The first heat insulating members 83*a* are formed of a material, such as a resin, having lower thermal conductivity than the heat-averaging member 66. The first heat insulating members 83*a* each extend along a part of the fixing belt 60 in the longitudinal direction thereof, and are arranged at positions between the heat-averaging member 66 and the second heat absorbing member 81 that do not have the first heat absorbing members 82. Excessive absorption of heat from the fixing belt 60 is avoided by inclusion of the first heat insulating members 83*a*. As a result, a temperature drop at a sheet passing portion can be prevented. Furthermore, reduction in the warm-up period and reduction in power consumption can be achieved.

The second heat insulating members 83*b* are formed of a material, such as a resin, having lower thermal conductivity than the heat-averaging member 66, and are each provided between the heat-averaging member 66 and a corresponding one of the first heat absorbing members 82. The amount of heat transmitted from the heat-averaging member 66 to the second heat absorbing member 81 through the first heat absorbing members 82 can be reduced by providing the second heat insulating members 83*b*.

Note that, when the second heat insulating members 83*b* are too thick, they prohibit transfer of heat accumulated in the fixing belt 60 to the second heat absorbing member 81, and a temperature at a no-sheet passing portion is more likely to increase. For this reason, it is necessary to optimize the thickness and the length of the second heat insulating members 83*b* depending on the temperature increase at a no-sheet passing portion. Nevertheless, the thickness thereof is smaller than the thickness of the first heat insulating members 83*a*.

The second heat absorbing member 81 is formed of a material having higher thermal conductivity than the second heat transmission units, and extends along the fixing belt 60 in the longitudinal direction thereof and is arranged so as to abut the first heat insulating members 83*a* and the first heat absorbing members 82.

The first heat absorbing members 82 are formed of a material having higher thermal conductivity than the second heat transmission units, and each extend along a part of the fixing belt 60 in the longitudinal direction thereof and are each arranged between a corresponding one of the second heat insulating members 83*b* and the second heat absorbing member 81. Particularly, the first heat absorbing members 82 are provided at positions that correspond to regions of the fixing belt 60 other than the central region thereof, i.e., that correspond to locations of the fixing belt 60 where temperature increases at no-sheet passing portions may occur. Although the first heat absorbing members 82 in this embodiment are provided so as to correspond to regions through which no sheets may pass, embodiments are not limited to this aspect. The first heat absorbing members 82 may be provided so as to extend in the longitudinal direction thereof into locations corresponding to a region through which sheets pass in every time.

The heat-averaging member 66 has the function of facilitating heat transmission in the axial direction, uniformly distributing heat across the fixing belt 60, and suppressing a temperature increase at a no-sheet passing portion. On the other hand, the first heat absorbing members 82 and the second heat absorbing member 81 have the function of facilitating heat transmission in the thickness direction and absorbing heat. In other words, the first heat absorbing members 82 and the second heat absorbing member 81 are provided to complement heat capacity shortage of the heat-averaging member 66. It is particularly desirable that the second heat absorbing member 81 should have a large heat capacity or have a large outer surface area for a larger amount of heat discharge.

The first retaining unit 80 and each of the bent parts 66*b* and 66*c* sandwich end regions of the sliding sheet 67 in the sliding direction thereof in between, whereby the sliding sheet 67 can be more securely fixed. Additionally, a temperature drop at a sheet passing portion can be prevented. Furthermore, reduction in the warm-up period and reduction in power consumption can be achieved.

The locations at which the first heat absorbing members 82 are provided are not limited to this embodiment. When temperature increases at no-sheet passing portions that cannot be suppressed by the heat-averaging member 66 occur at a plurality of discrete locations, the first heat absorbing members 82 may be provided at those discrete locations. In such a case, the thickness and length of the second heat insulating members 83*b* may be set depending on the temperature increases at the respective no-sheet passing portions. The sum of the thickness of the first heat absorbing members 82 and the thickness of the second heat insulating members 83*b* substantially is equal to the thickness of the first heat insulating members 83*a*. Thus, the second heat absorbing member 81 and each of the first heat absorbing members 82 make surface contact with each other, so that heat is favorably transmitted therebetween.

Additionally, inclusion of the bent parts 66*b* and 66*c* in the heat-averaging member 66 improves workability when the first heat insulating members 83*a*, the second heat insulating members 83*b*, the second heat absorbing member 81, and the first heat absorbing members 82 are mounted on the heat-averaging member 66. This inclusion also enables the first heat insulating members 83*a*, the second heat insulating members 83*b*, the second heat absorbing member 81, and the first heat absorbing members 82 to be reliably accommodated in the heat-averaging member 66. Additionally, projecting parts may be provided on the upper surface of the heat-averaging member 66 with holes to engage with the projecting parts being formed in the first heat insulating members 83*a*, the second heat insulating members 83*b*, the second heat absorbing member 81, and/or the like.

Next, a second retaining unit is described.

Figure 19:
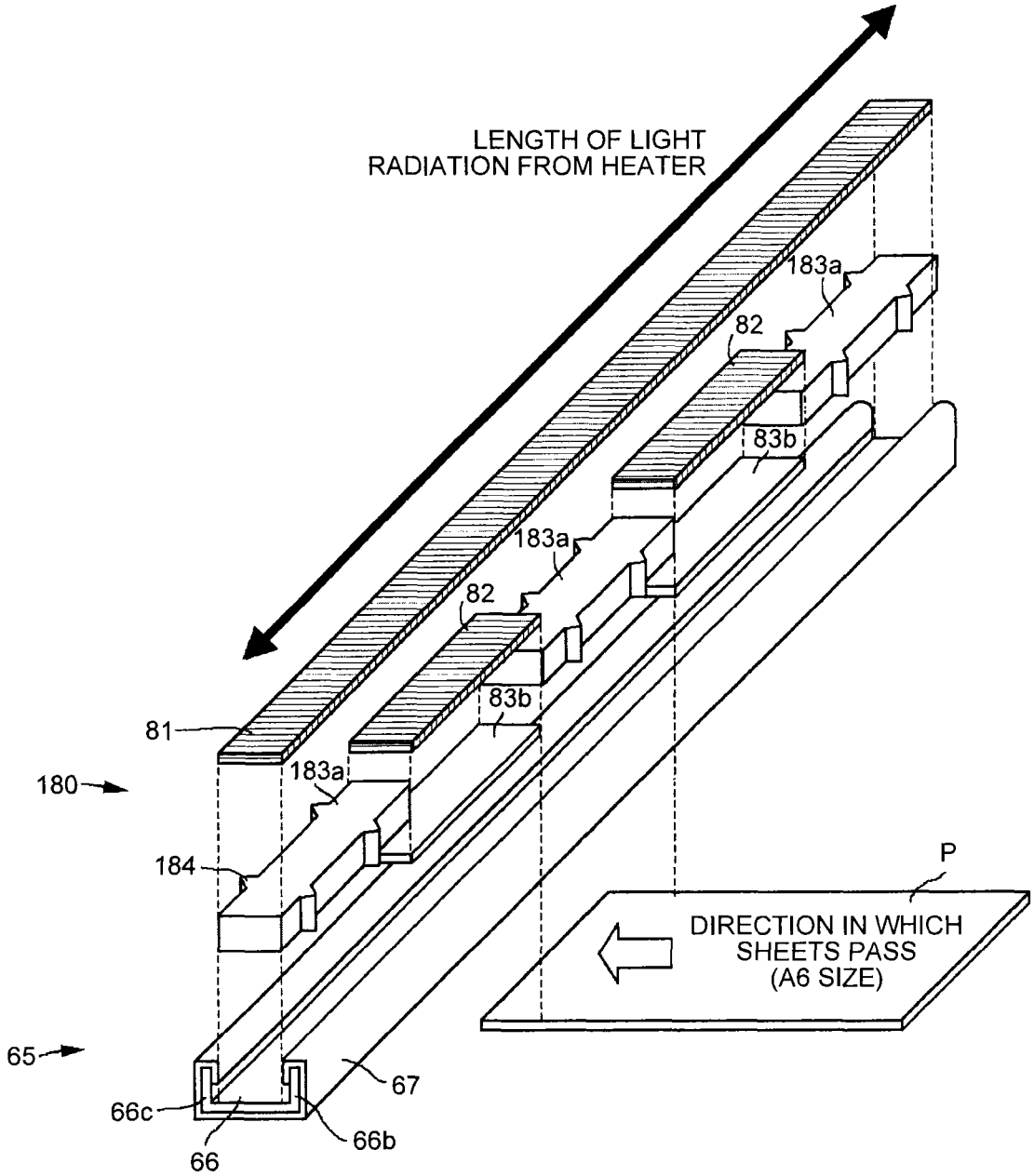
FIG. 19 is an exploded perspective view explaining a second retaining unit of the image forming apparatus illustrated in FIG. 1.

As illustrated in FIG. 19, a second retaining unit 180 is different in shape of first heat insulating members 183*a* as compared with the first retaining unit 80. Each of the first heat insulating members 183*a* includes a plurality of projecting parts 184 on surfaces thereof facing the bent parts 66*b* and 66*c* in a state where it is mounted on the nip-forming member 65. Thus, end regions of the sliding sheet 67 in the sliding direction thereof can be pinched with these projecting parts 184 and the bent parts 66*b* and 66*c*, whereby the sliding sheet 67 can be more securely retained. It is desirable that the projecting parts 184 make line contact or point contact with the sliding sheet 67, not surface contact.

The projecting parts 184 is not limited to the aspect in which they are provided on the first heat insulating members, and the projecting parts 184 may be provided on at least one of the members included in the second retaining unit 180. Furthermore, the number of the projecting parts 184 is not limited to twelve as in this embodiment, and may be more than or less than twelve.

When the salient amount of the projecting parts 184 is not optimal, the heat-averaging member 66 cannot resist to the stiffness of the sliding sheet 67 and comes out, resulting in separation between the heat-averaging member 66 and the second retaining unit 180. As a result, the heat averaging (heat conducting) effect is reduced. Additionally, the thickness of the second retaining unit 180 increases, so that the durability of the fixing belt 60 is decreased because of an increased load thereon in the stretched direction thereof. Thus, it is desirable that the projecting parts 184 be set in consideration of the amount of compression of the sliding sheet 67.

Next, a third retaining unit is described.

Figure 20:
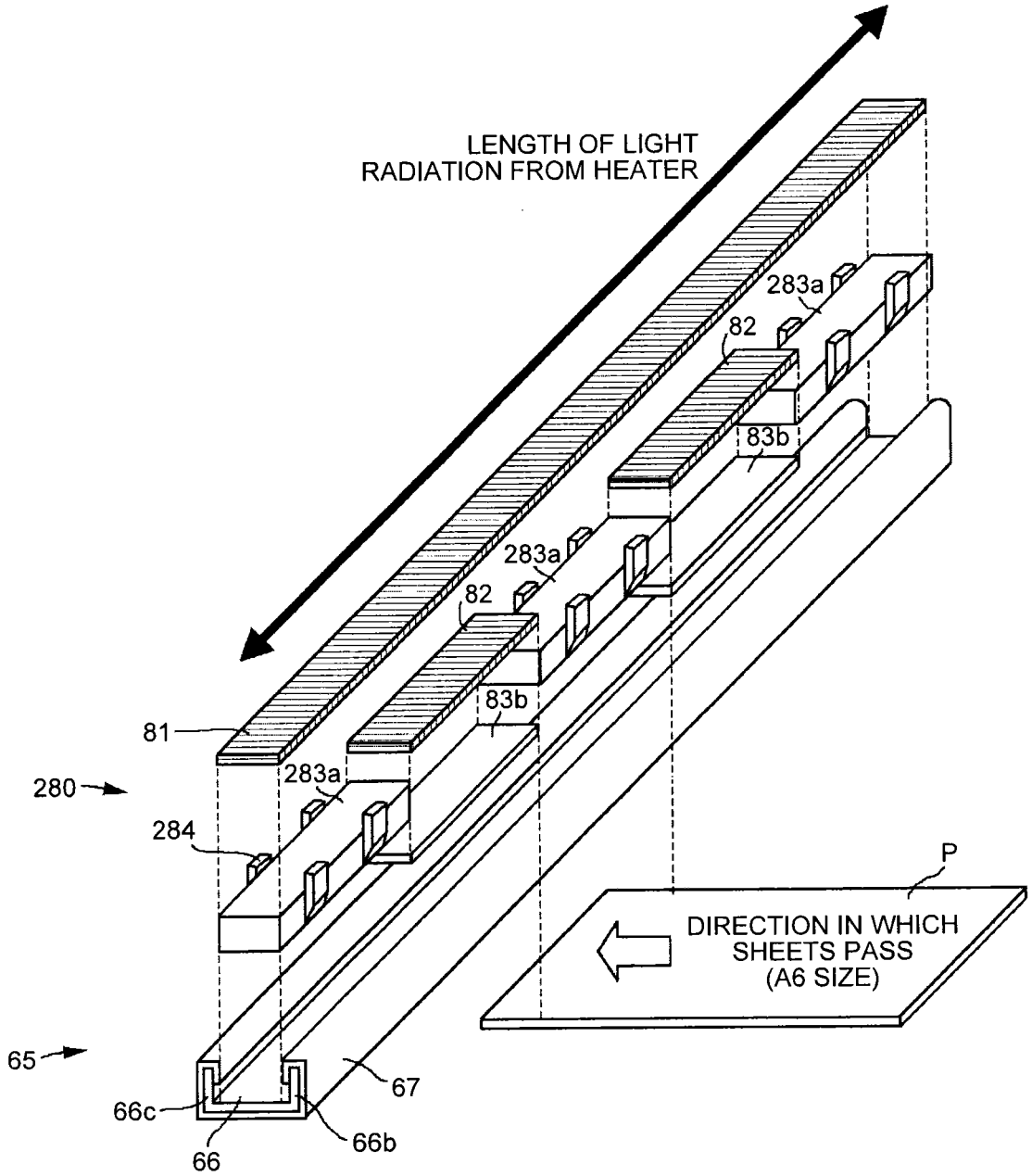
FIG. 20 is an exploded perspective view explaining a third retaining unit of the image forming apparatus illustrated in FIG. 1.

As illustrated in FIG. 20, a third retaining unit 280 is different in shape of first heat insulating members 283*a* as compared with the first retaining unit 80. Each of the first heat insulating members 283*a* includes a plurality of lugs 28 each having a shape of a projecting part on surfaces thereof facing the bent parts 66*b* and 66*c* in a state where it is mounted on the nip-forming member 65. Thus, end regions of the sliding sheet 67 in the sliding direction thereof can be pinched with the lugs 284 and the bent parts 66*b* and 66*c*, whereby the position of the sliding sheet 67 can be more securely fixed.

The lugs 284 have a shape projecting toward one surface of the first heat insulating member 283*a* opposite from the surface thereof that makes contact with the heat-averaging member 66. The projection amount thereof is high enough to accommodate the second heat absorbing member 81. Thus, workability when the second heat absorbing member 81 is mounted on the first heat insulating members 282*a* is improved. Additionally, the second heat absorbing member 81 can be reliably received on the first heat insulating members 282*a*. Furthermore, when the third retaining unit 280 is mounted on the nip-forming member 65, the lugs 284 are pressed. As a result, the third retaining unit 280 can be reliably mounted on the nip-forming member 65 without pressing the second heat absorbing member 81.

The lugs 284 is not limited to the aspect in which it is provided on the first heat insulating members, and the lugs 284 may be provided on at least one of the members included in the third retaining unit 280.

It is particularly desirable that the lugs 284 be provided on the second heat insulating members 83*b* in addition to the first heat insulating members 283*a*. The projection amount of the lugs (not illustrated) provided on the second heat insulating members 83*b* is high enough to accommodate the second heat absorbing member 81 and the first heat absorbing members 82. Thus, workability when the second heat absorbing member 81 and the first heat absorbing members 82 are mounted on the second heat insulating members is improved. Additionally, the second heat absorbing member 81 and the first heat absorbing members 82 can be reliably received on the second heat insulating members. Furthermore, when the third retaining unit 280 is mounted on the nip-forming member 65, the lugs can be pressed. As a result, the third retaining unit 280 can be reliably mounted on the nip-forming member 65 without pressing the second heat absorbing member 81.

Furthermore, the number of the lugs 284 is not limited to twelve as in this embodiment, and may be more than or less than twelve.

When the protruding amount of the lugs 284 is not optimal, the heat-averaging member 66 cannot resist to the stiffness of the sliding sheet 67 and comes out, resulting in separation between the heat-averaging member 66 and the third retaining unit 280. As a result, the heat averaging (heat conducting) effect is reduced. Additionally, the thickness of the third retaining unit 280 increases, so that the durability of the fixing belt 60 is decreased because of an increased load thereon in the stretched direction thereof. Thus, it is desirable that the lugs 284 be set in consideration of the amount of compression of the sliding sheet 67.

Next, a fourth retaining unit is described.

Figure 21:
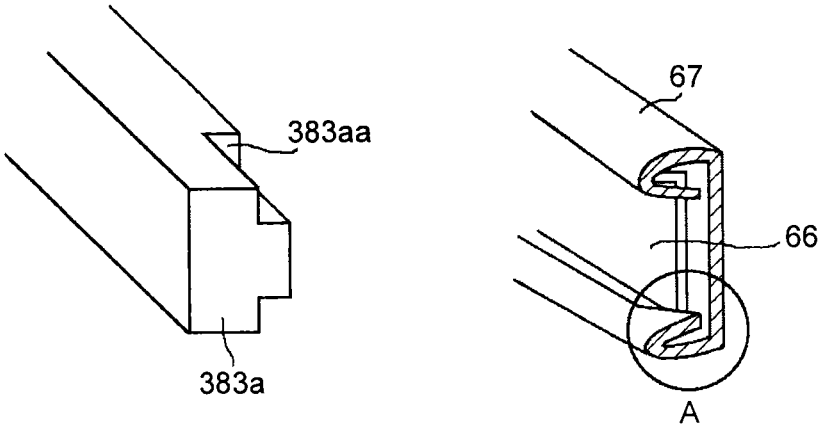
FIG. 21 is an illustration explaining a fourth retaining unit of the image forming apparatus illustrated in FIG. 1.

As illustrated in FIG. 21, a fourth retaining unit 380 is different in shape of heat insulating members 383*a*, which abut the heat-averaging member 66, as compared with the first retaining unit 80. The first heat insulating members 383*a* include recess parts 383*aa* at both ends in the longitudinal direction thereof and at both ends in the sliding direction of the sliding sheet 67. Thus, entanglement of the sliding sheet 67 can be prevented and the separation can be suppressed.

The heat-averaging member 66 is exposed if it is not appropriately covered by the sliding sheet 67. In such a case, the exposed portion of the heat-averaging member 66 makes contact with the fixing belt 60, resulting in abrasion of the fixing belt 60. In order to prevent this abrasion from occurring, it is desirable that the longitudinal length of the sliding sheet 67 be longer than the longitudinal length of the heat-averaging member 66.

In this case, both longitudinal ends of the sliding sheet 67 is wrapped around the heat-averaging member 66, for example, diagonally in a manner indicated by A in FIG. 21, and the amount of the wrapped-around portions may be increased. Thus, there is a risk that the sliding sheet 67 reaches the abutting part 66*a* of the heat-averaging member 66. As a result, the sliding sheet 67 is stuck between the heat-averaging member 66 and the first heat insulating member 383*a*, resulting in separation therebetween, and further resulting in unfavorable conditions such as reduction in heat averaging effect and increase in the thickness of the retaining unit.

For this reason, to solve the above-described issue, it is particularly advantageous to configure the first heat insulating members 383*a* to include the recess parts 383*aa* at both longitudinal ends and at both ends in the sliding direction of the sliding sheet 67.

Next, a fifth retaining unit is described.

Figure 22:
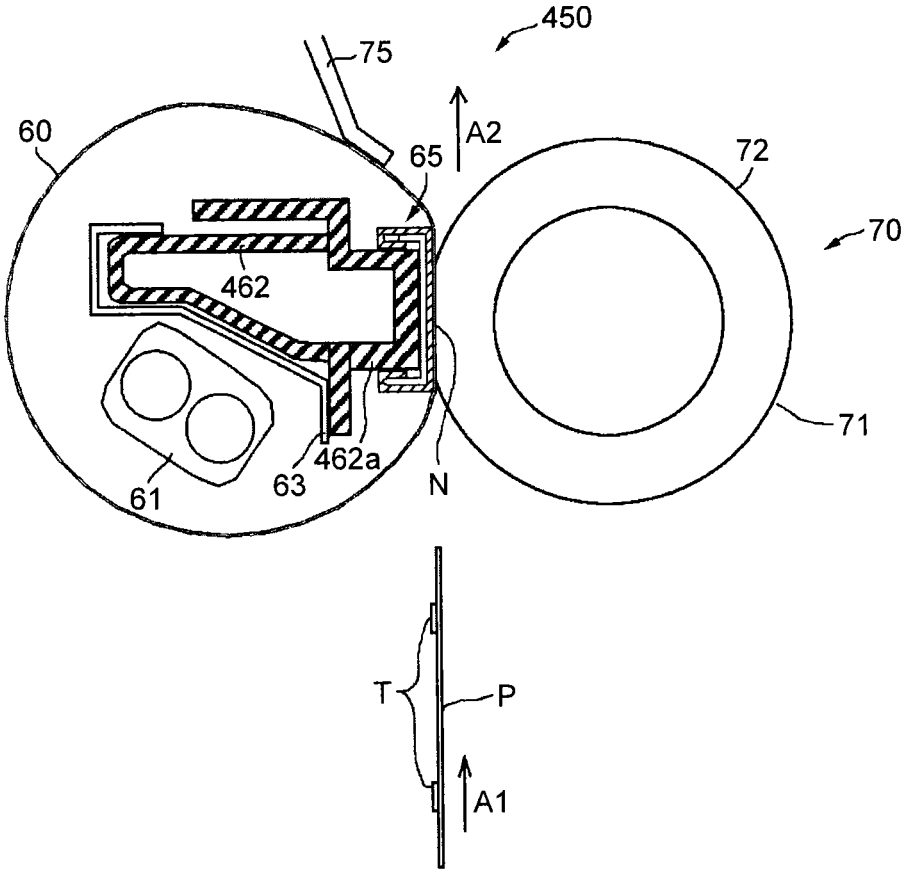
FIG. 22 is an illustration explaining a fifth retaining unit of the image forming apparatus illustrated in FIG. 1.

As illustrated in FIG. 22, a fifth retaining unit 480 differs in that it includes, in place of the first retaining unit 80, a protruding part 462*a* obtained by protruding a part of the shape of the support member 462 as a support unit. The protruding part 462*a* is formed over the longitudinal direction of the fixing belt 60. Provision of the protruding part 462*a* in the support member 462 makes it possible to eliminate the need of a separate member to retain the nip-forming member 65, resulting in cost reduction.

Additionally, the protruding part 462*a* may include, as a plurality of projecting parts, bead parts or embossed parts that face the bent parts 66*b* and 66*c*. The sliding sheet 67 is pinched between these projecting parts and the bent parts 66*b* and 66*c*, whereby the position of the sliding sheet 67 can be more securely fixed. It is desirable that projecting parts 184 make line contact or point contact with the sliding sheet 67, not surface contact.

Additionally, recess parts (not illustrated) may be provided at both ends in the longitudinal direction of the protruding part 462*a* and at both ends in the sliding direction of the sliding sheet 67. This inclusion of the recess parts makes it possible to prevent entanglement of the sliding sheet 67 and suppress the separation.

Note that, in the above-described embodiments, as examples of specific aspects of the nip-forming member 65 and the retaining units 80, 180, 280, 380, and 480, the thicknesses of the following members are set as follows when the width of the nip formed by the pressure roller 70 and the nip-forming member 65 with the fixing belt 60 therebetween is about 10.0 mm. The thickness of the heat-averaging member 66 is set to 0.2 to 1.0 mm; the thickness of the first heat absorbing member 81 is set to 1.8 to 6.0 mm; the thickness of the second heat absorbing members 82 is set to 1.0 to 2.0 mm; the thickness of the second heat insulating members 83*b* is set to 0.5 to 1.5 mm; and the thicknesses of the first heat insulating members 83*a*, 183*a*, and 283*a* are set to 1.5 to 3.5 mm.

Furthermore, examples of specific aspects of the materials of the heat-averaging member 66, the first heat absorbing member 81 and the second heat absorbing members 82 may include carbon nanotube (thermal conductivity: 3000 to 5500 W/mK), a graphite sheet (thermal conductivity: 700 to 1750 W/mK), silver (thermal conductivity: 420 W/mK), copper (thermal conductivity: 398 W/mK) and aluminum (thermal conductivity: 236 W/mK).

Furthermore, examples of specific aspects of the materials of the first heat insulating members 83*a*, 183*a*, and 283*a* and the second heat insulating members 83*b* may include polyphenylene sulfide (PPS) (thermal conductivity: 0.2 W/mK), polyamide-imide (PAI) (thermal conductivity: 0.29 to 0.6 W/mK), polyether ether ketone (PEEK) (thermal conductivity: 0.26 W/mK), and polyether ketone (PEK) (thermal conductivity: 0.29 W/mK), and a liquid crystal polymer (LCP) (thermal conductivity: 0.2 W/mK).

Figure 23:
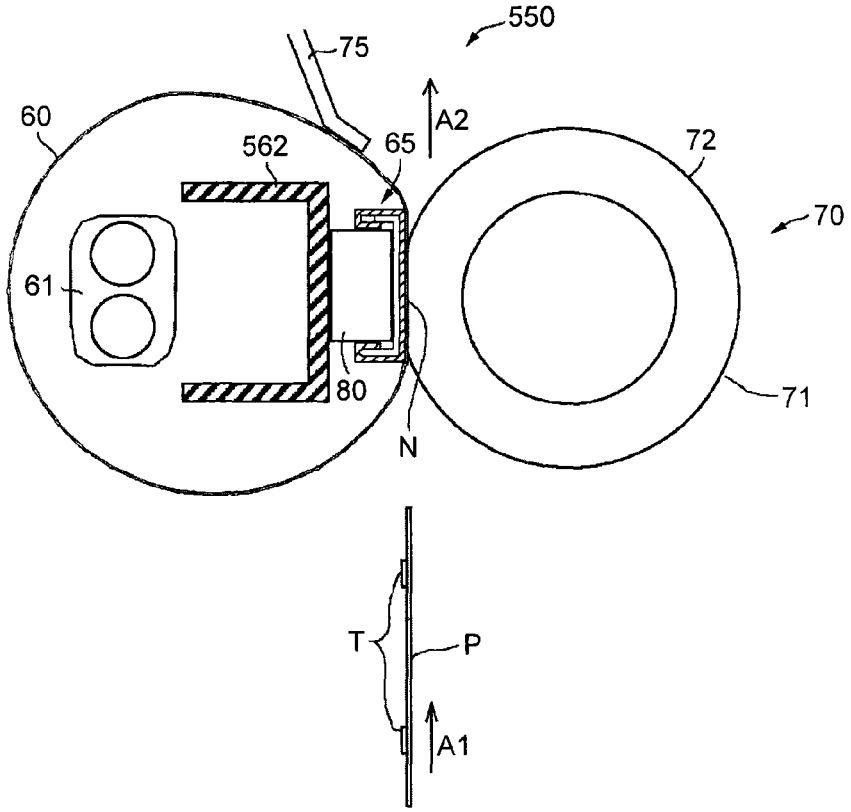
FIG. 23 is a configuration diagram schematically illustrating a fixing device of an image forming apparatus according to another embodiment of the present invention.
Figure 24A:
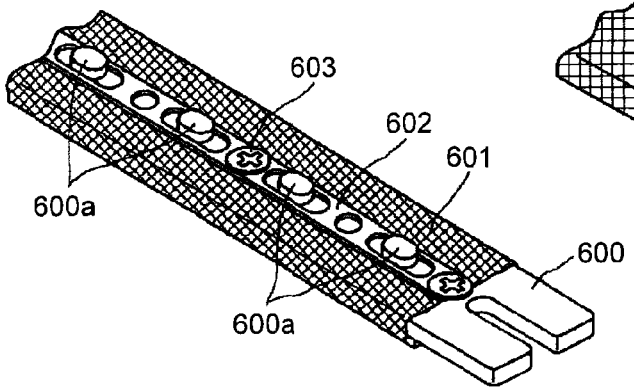
FIGS. 24A and 24B are illustrations explaining a fixing device in a related art.
Figure 24B:
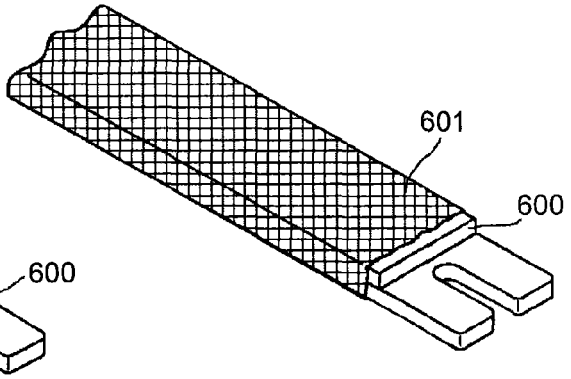
Figure 25:
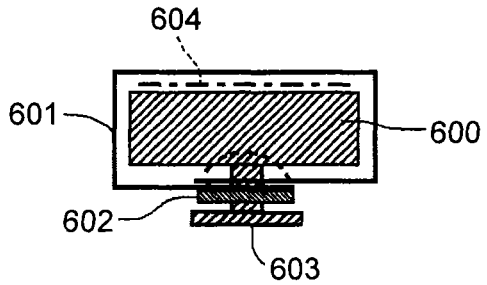
FIG. 25 is an illustration explaining the fixing device in the related art.

Although embodiments of the present invention have been described above, the present invention is not limited to the embodiments. For example, the present invention can be applied to a fixing device as illustrated in FIG. 23, which can achieve the same operations and effects as in the above-described embodiment. This fixing device 550 includes a support member 562 having a shape simpler than the shapes of the comparable one of the fixing device in the above-described embodiment.

Additionally, although the heat transmission units have been described as the heat-averaging member, the heat insulating members, and the heat absorbing members in the above embodiment, such description has been given to explain representative operations for enabling the operations of the present invention, based on comparison between the first to the fourth heat transmission units. Although the first heat transmission unit has been described as the heat-averaging member, operations thereof are not limited to a heat averaging operation and may include a heat absorbing or heat insulating operation. The second heat transmission units have been described as the heat insulating members, operations thereof are not limited to a heat insulating operation, and may include a heat absorbing or heat averaging operation. The third heat transmission units and the fourth heat transmission units have been described as the heat absorbing members, operations thereof are not limited to a heat absorbing operation, and may include a heat averaging or heat insulating operation.

Furthermore, the materials and sizes of the components provided in the above-described embodiment are mere examples, and obviously can be selected from various materials and sizes in so far as the operations of the present invention can be achieved.

An embodiment makes it possible to provide a fixing device that, while having a simple structure, prevents temperature increase at a no-sheet passing portion and has a fixing belt the durability and temperature stability of which are ensured.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a rotatable fixing member formed as an endless belt;

a heat source to heat the fixing member;

a nip-forming member being not rotatable and arranged inside the fixing member; and a pressure member arranged outside the fixing member so as to face the nip-forming member, the pressure member forming a nip between the pressure member and the fixing member, wherein the fixing device causes a recording medium bearing an unfixed image to pass through the nip to fix the unfixed image to the recording medium, the nip-forming member is formed of a first heat transmission unit and a sheet, the first heat transmission unit includes an abutting part abutting the fixing member with the sheet therebetween, and a bent part or bent parts extending inside the fixing member at upstream or upstream and downstream of the nip in a transport direction of the recording medium, and a retaining part to catch and retain the sheet is provided at a tip of at least the bent part at upstream of the nip in the transport direction of the recording medium.

2. The fixing device according to claim 1, wherein the retaining part is formed of a plurality of acute projections, and at least some of the projections penetrate the sheet.

3. The fixing device according to claim 2, wherein the projections are arranged in a longitudinal direction of the nip-forming member at intervals that are at least partially irregular.

4. The fixing device according to claim 1, wherein the retaining part includes a projecting part protruding inside the first heat transmission unit from the tip of the bent part.

5. The fixing device according to claim 4, wherein the protruding part is a burr generated in a manufacturing process of the first heat transmission unit.

6. The fixing device according to claim 1, wherein the first heat transmission unit is provided with a protrusion at downstream of the nip in the transport direction of a recording medium, the protrusion protruding toward the pressure member.

7. The fixing device according to claim 1, wherein the sheet is bonded to the first heat transmission unit.

8. The fixing device according to claim 1, wherein a crease is formed on the sheet before being caught by the retaining unit.

9. The fixing device according to claim 1, further comprising a retaining unit to retain the nip-forming member, wherein the retaining unit retains the sheet by having an end region of the sheet in the sliding direction thereof pinched between the retaining unit and the bent part.

10. The fixing device according to claim 9, wherein the retaining unit is provided with at least one projecting part on a surface thereof facing the bent part.

11. The fixing device according to claim 9, wherein the retaining unit includes a second heat transmission unit abutting the first heat transmission unit and having lower thermal conductivity than the first heat transmission unit, and at least one third heat transmission unit abutting the second heat transmission unit, having higher thermal conductivity than the second heat transmission unit, and arranged at a position other than a central region of the fixing member.

12. The fixing device according to claim 11, wherein the second heat transmission unit is provided with at least one lug formed as a protrusion on a surface thereof facing the bent part, the lug protrudes in a direction going away from the first heat transmission unit and receives the third heat transmission unit.

13. The fixing device according to claim 9, wherein the retaining unit is a support unit that has a longitudinal end thereof fixed and supports the nip-forming member, and the support unit abuts the first heat transmission unit.

14. The fixing device according to claim 9, wherein recess parts are provided at both longitudinal end regions of the retaining unit and on a surface thereof that abuts the first heat transmission unit.

15. An image forming apparatus including the fixing device according to claim 1.

16. The fixing device according to claim 1, wherein the retaining part is formed of a plurality of acute projections.

17. The fixing device according to claim 1, wherein a back surface of the abutting part and the sheet do not contact with each other.

18. The fixing device according to claim 1, wherein the sheet includes a double structure.

* * * * *